US012179253B2

(12) United States Patent
Morijiri et al.

(10) Patent No.: US 12,179,253 B2
(45) Date of Patent: Dec. 31, 2024

(54) BINDING MACHINE

(71) Applicant: MAX CO., LTD., Tokyo (JP)

(72) Inventors: Takeshi Morijiri, Tokyo (JP); Norihiro Nagai, Tokyo (JP); Nobutaka Tashima, Tokyo (JP); Kozo Iwaki, Tokyo (JP); Shinpei Sugihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 319 days.

(21) Appl. No.: 17/273,444

(22) PCT Filed: Sep. 5, 2019

(86) PCT No.: PCT/JP2019/035088
§ 371 (c)(1),
(2) Date: Mar. 4, 2021

(87) PCT Pub. No.: WO2020/050384
PCT Pub. Date: Mar. 12, 2020

(65) Prior Publication Data

US 2021/0197248 A1 Jul. 1, 2021

(30) Foreign Application Priority Data

Sep. 7, 2018 (JP) ..... 2018-168249
Aug. 28, 2019 (JP) ..... 2019-156058

(51) Int. Cl.
*B21F 15/04* (2006.01)
*E04G 21/12* (2006.01)

(52) U.S. Cl.
CPC ..... *B21F 15/04* (2013.01); *E04G 21/123* (2013.01)

(58) Field of Classification Search
CPC ..... B21F 15/04; E04G 21/123; B65B 13/28; B65B 13/285; B65B 13/185
(Continued)

(56) References Cited

U.S. PATENT DOCUMENTS 4,834,148 A * 5/1989 Muguruma ..... E04G 21/122 140/57
4,941,515 A 7/1990 Vrenning
(Continued)

FOREIGN PATENT DOCUMENTS

CN 1066649 C 6/2001
CN 101300395 A 11/2008
(Continued)

OTHER PUBLICATIONS

JPH07290177A—Toyoda (Nov. 7, 1995) (machine translation) (Year: 1995).*
(Continued)

*Primary Examiner* — Christopher L Templeton
*Assistant Examiner* — Fred C Hammers
(74) *Attorney, Agent, or Firm* — Banner & Witcoff, Ltd.

(57) ABSTRACT

A binding machine includes a first body part having an operation part, a second body part having a feeding unit configured to feed a wire, a guide part configured to guide the wire to a surrounding of a binding object, and a twisting unit configured to twist the wire, thereby binding the binding object, an elongated connecting part configured to connect the first body part and the second body part, a first output unit configured to detect an operation on the operation part and to output a first signal, a second output unit configured to detect that the binding object is inserted in a feeding path of the wire and to output a second signal, and a control unit that controls the feeding unit and the twisting unit to execute a binding operation when the control unit detects the first signal and the second signal.

12 Claims, 27 Drawing Sheets

(58) Field of Classification Search
USPC ..... 140/93.6, 118; 73/514.01
See application file for complete search history.

(56) References Cited

U.S. PATENT DOCUMENTS

| | | | | |
|---|---|---|---|---|
| 5,323,816 | A | 6/1994 | Hoyaukin | |
| 5,657,799 | A | 8/1997 | Kusakari et al. | |
| 5,944,064 | A * | 8/1999 | Saito | E04G 21/122 140/57 |
| 5,947,166 | A * | 9/1999 | Doyle | E04G 21/122 140/57 |
| 7,143,792 | B2 | 12/2006 | Ishikawa et al. | |
| 8,844,434 | B2 * | 9/2014 | Barnes | E04G 21/122 100/31 |
| 10,045,776 | B2 * | 8/2018 | Shelton, IV | A61B 17/295 |
| 11,365,552 | B2 * | 6/2022 | Morijiri | B21F 15/04 |
| 2002/0043452 | A1 * | 4/2002 | Hori | F21V 23/04 200/293 |
| 2006/0157139 | A1 | 7/2006 | Hoyaukin | |
| 2006/0283516 | A1 | 12/2006 | Nagaoka et al. | |
| 2009/0160373 | A1 | 6/2009 | Katou et al. | |
| 2009/0283172 | A1 | 11/2009 | Itagaki | |
| 2010/0147411 | A1 | 6/2010 | Kusakari et al. | |
| 2010/0313991 | A1 | 12/2010 | Nagaoka et al. | |
| 2011/0146833 | A1 * | 6/2011 | Kusakari | E04G 21/123 140/111 |
| 2011/0155277 | A1 * | 6/2011 | Coles | E04G 21/122 140/93.6 |
| 2012/0160364 | A1 | 6/2012 | Katou et al. | |
| 2014/0246114 | A1 | 9/2014 | Kusakari et al. | |
| 2014/0246115 | A1 | 9/2014 | Itagaki | |
| 2015/0048194 | A1 | 2/2015 | Itagaki | |
| 2015/0232212 | A1 | 8/2015 | Itagaki | |
| 2015/0267423 | A1 | 9/2015 | Kusakari et al. | |
| 2016/0069096 | A1 | 3/2016 | Kodi | |
| 2016/0186451 | A1 | 6/2016 | Itagaki | |
| 2016/0222683 | A1 | 8/2016 | Kusakari et al. | |
| 2016/0297555 | A1 | 10/2016 | Itagaki | |
| 2017/0145704 | A1 | 5/2017 | Coles et al. | |
| 2017/0305584 | A1 | 10/2017 | Itagaki | |
| 2018/0207709 | A1 | 7/2018 | Kasahara et al. | |
| 2018/0235724 | A1 * | 8/2018 | Nowatschin | B25J 13/02 |
| 2018/0252743 | A1 * | 9/2018 | Rastegar | G01B 21/08 |
| 2018/0363309 | A1 | 12/2018 | Kusakari et al. | |
| 2019/0002139 | A1 | 1/2019 | Itagaki | |
| 2019/0093374 | A1 | 3/2019 | Machida et al. | |
| 2019/0203486 | A1 * | 7/2019 | Coles | E04G 21/123 |
| 2019/0389609 | A1 | 12/2019 | Itagaki | |
| 2021/0387246 | A1 | 12/2021 | Kasahara et al. | |

FOREIGN PATENT DOCUMENTS

| | | | |
|---|---|---|---|
| CN | 101585419 | A | 11/2009 |
| CN | 101748897 | A | 6/2010 |
| EP | 0249737 | A2 | 12/1987 |
| EP | 1612348 | A1 | 1/2006 |
| JP | H02-501321 | T | 5/1990 |
| JP | H06-501529 | T | 2/1994 |
| JP | H07-290177 | A | 11/1995 |
| JP | H07290177 | * | 11/1995 |
| JP | H09-013677 | A | 1/1997 |
| JP | 2005194847 | A | 7/2005 |
| JP | 2011-152606 | A | 8/2011 |
| JP | 4874094 | B2 | 12/2011 |
| JP | WO2017199858 | * | 5/2017 |
| JP | 2017-189822 | A | 10/2017 |
| RU | 2248920 | C2 | 3/2005 |
| RU | 2440233 | C2 | 1/2012 |
| WO | 2017/014276 | A1 | 1/2017 |
| WO | 2017/199858 | A1 | 11/2017 |

OTHER PUBLICATIONS

WO2017199858 (MT) (Year: 2017).*

International Search Report for PCT/JP2019/035088 dated Nov. 19, 2019, 2 pages.

PCT/ISA/237 form for PCT/JP2019/035088 dated Nov. 5, 2019, 5 pages.

Russian Office Action dated Nov. 16, 2022, issued by the Federal Service for Intellectual Property in the corresponding Russian Patent Application No. 2021105540. (15 pages).

Oct. 22, 2024—(JP) Notice of Reasons for Refusal—JP App 2023-131065, Eng Tran.

* cited by examiner

BINDING MACHINE

CROSS REFERENCE TO RELATED APPLICATION

This application is a 35 U.S.C. 371 national phase entry application from PCT/JP2019/035088, filed Sep. 5, 2019, which claims priority to Japanese patent application no. 2018-168249, filed Sep. 7, 2018, and Japanese patent application no. 2019-156058, filed Aug. 28, 2019, the disclosures of which are incorporated herein in their entirety by reference, and priority is claimed to each of the foregoing.

TECHNICAL FIELD

The present disclosure relates to a binding machine configured to bind a binding object such as a reinforcing bar and the like with a wire.

BACKGROUND ART

In the related art, suggested is a binding machine referred to as a reinforcing bar binding machine configured to wind a wire around elongated bodies such as reinforcing bars, to twist the wire, and to bind reinforcing bars with the wire (for example, refer to PTL 1).

In the binding machine disclosed in PTL 1, a handle having an activation switch is connected to another part of the machine via a telescopic part, so that an entire length of the machine can be adjusted depending on the operator's height. In the binding machine disclosed in PTL 1, the elongated bodies such as reinforcing bars are inserted between two fixed claws and the activation switch is operated, so that the elongated bodies are bound with the wire.

CITATION LIST

Patent Literature

[PTL 1] Japanese Patent No. 4,874,094

SUMMARY OF INVENTION

Technical Problem

It is assumed that the binding machine disclosed in PTL 1 is used for an operation of binding a binding object arranged on a floor surface. In this case, the operator is distant from the binding object, so that it is difficult to check whether the binding object is located at a center between the two fixed claws. When the activation switch is operated under this situation, the binding operation may be executed even though the binding object is not located at the center between the two fixed claws.

The binding machine of the present disclosure has been made in view of the above situation, and an object thereof is to provide a binding machine capable of suppressing a careless binding operation from being executed.

Solution to Problem

In order to achieve the above object, a binding machine of the present disclosure includes: a first body part having an operation part that can be operated by an operator; a second body part having a feeding unit configured to feed a wire, a guide part configured to guide the wire fed by the feeding unit to a surrounding of a binding object, and a twisting unit configured to twist the wire guided by the guide part, thereby binding the binding object; an elongated connecting part configured to connect the first body part and the second body part; a first output unit configured to detect an operation on the operation part and to output a first signal; a second output unit configured to detect that the binding object is inserted in a feeding path of the wire guided by the guide part and to output a second signal; and a control unit configured to detect the first signal output from the first output unit, wherein the control unit controls the feeding unit and the twisting unit to execute a binding operation when the second signal output from the second output unit is detected. In addition, a binding machine of the present disclosure includes a first body part having a handle part that can be gripped by an operator; a second body part having a feeding unit configured to feed a wire, a guide part configured to guide the wire fed by the feeding unit to a surrounding of a binding object, and a twisting unit configured to twist the wire guided by the guide part, thereby binding the binding object; an elongated connecting part configured to connect the first body part and the second body part; and a direction detection unit configured to detect a direction of the guide part with respect to a direction of gravity.

Advantageous Effects of Invention

According to the binding machine of the present disclosure, the binding operation is not executed unless the operator operates the operation part provided to the first body part, so that it is possible to suppress a careless binding operation from being executed. In addition, the binding operation is not executed unless the direction of the guide part with respect to the direction of gravity is within the predetermined binding allowable range, so that it is possible to suppress a careless binding operation from being executed.

DESCRIPTION OF EMBODIMENTS

Hereinbelow, examples of the reinforcing bar binding machine as embodiments of the binding machine of the present invention will be described with reference to the drawings.

Example of Reinforcing Bar Binding Machine of First Embodiment

Figure 1:
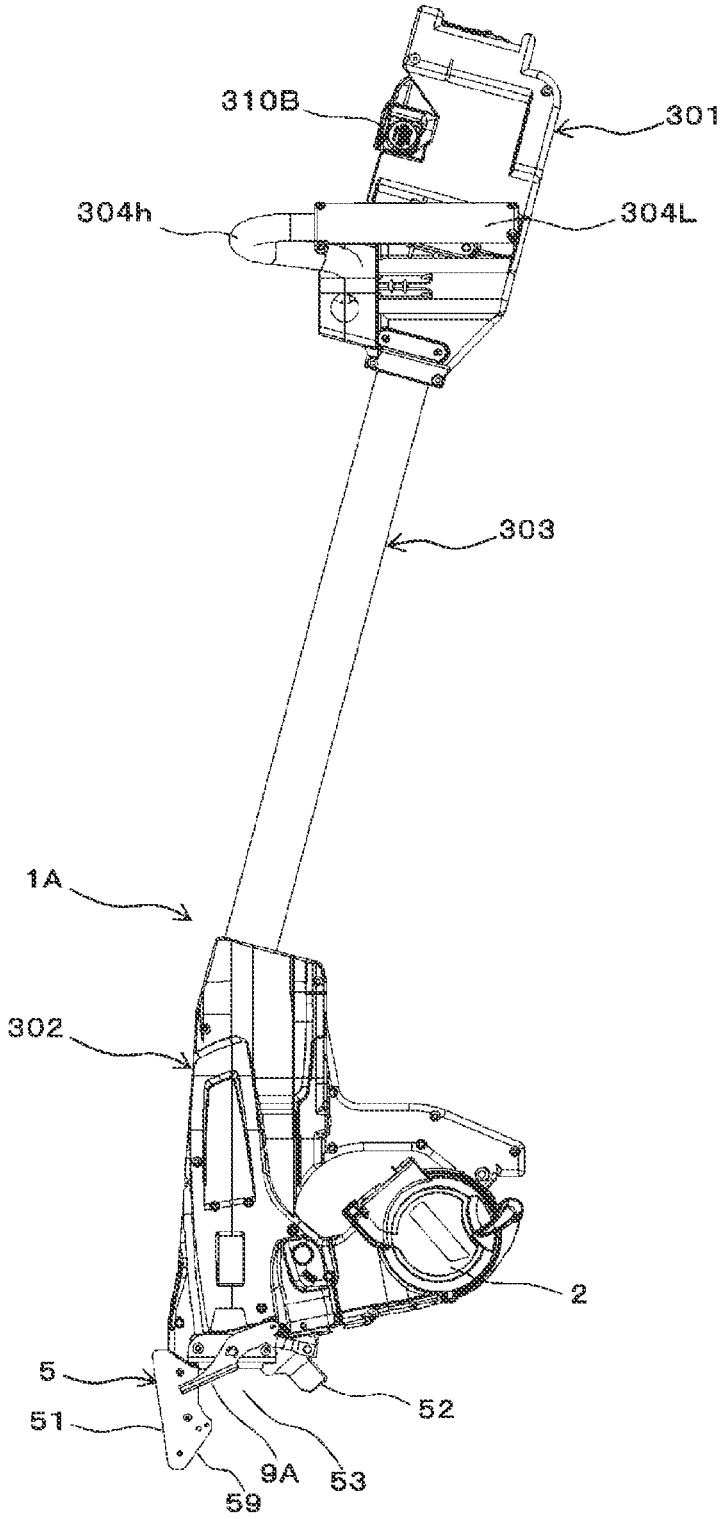
FIG. 1 is a side view depicting an example of an overall configuration of a reinforcing bar binding machine of a first embodiment.
Figure 2:
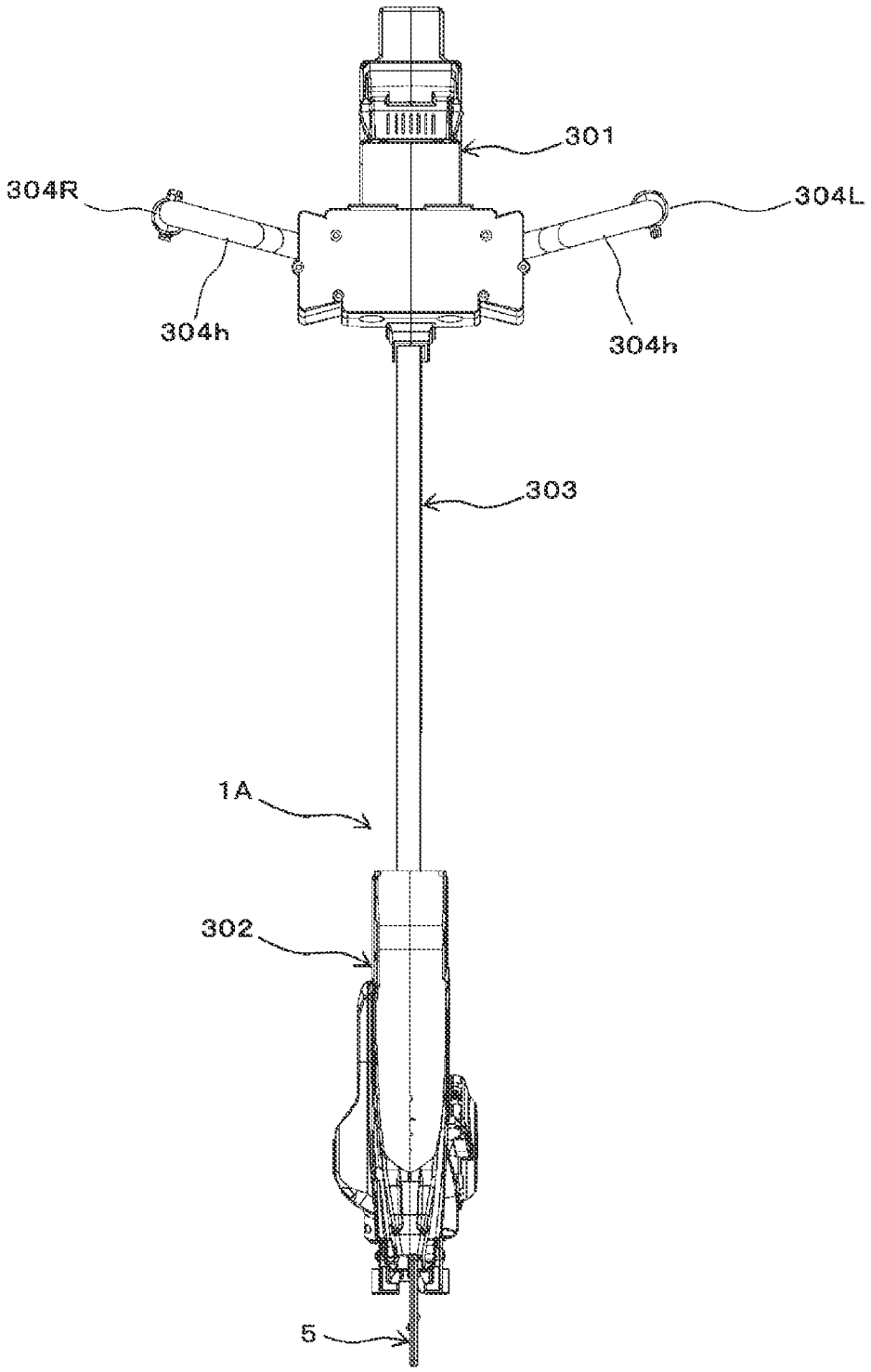
FIG. 2 is a top view depicting the example of the overall configuration of the reinforcing bar binding machine of the first embodiment.
Figure 3:
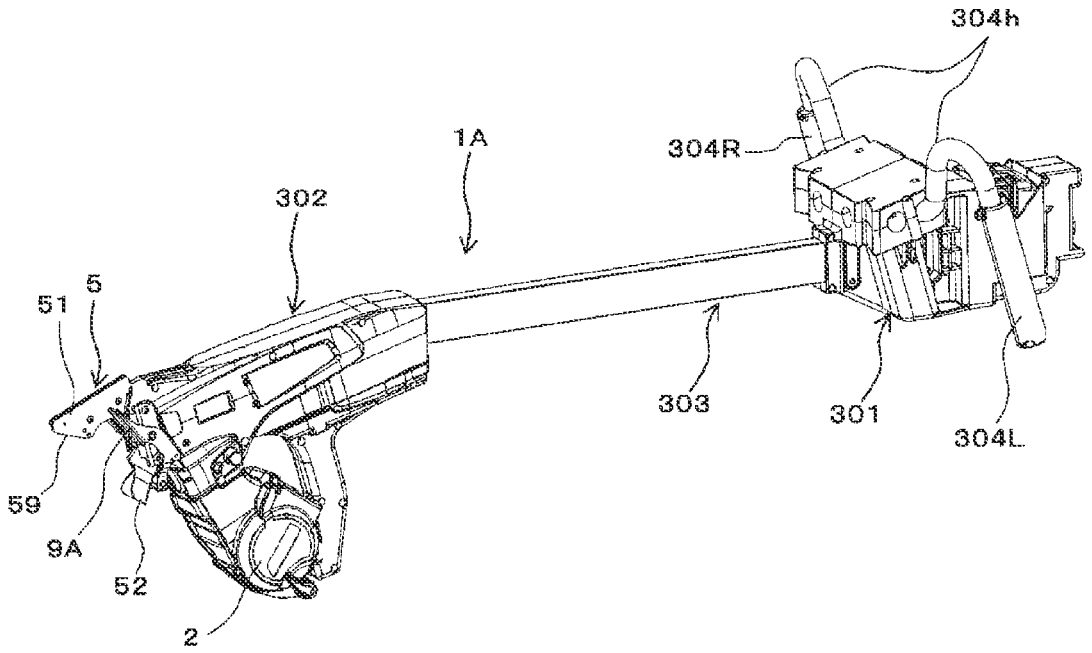
FIG. 3 is a perspective view depicting the example of the overall configuration of the reinforcing bar binding machine of the first embodiment.
Figure 4:
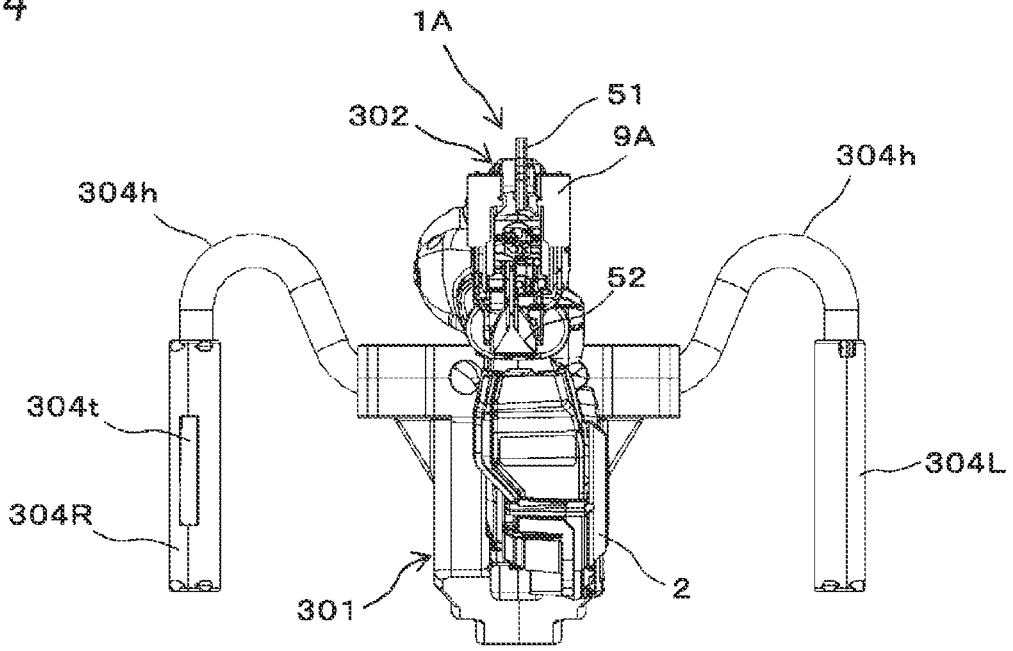
FIG. 4 is a front view depicting the example of the overall configuration of the reinforcing bar binding machine of the first embodiment.

FIG. 1 is a side view depicting an example of an overall configuration of a reinforcing bar binding machine of a first embodiment, FIG. 2 is a top view depicting the example of the overall configuration of the reinforcing bar binding machine of the first embodiment, FIG. 3 is a perspective view depicting the example of the overall configuration of the reinforcing bar binding machine of the first embodiment, and FIG. 4 is a front view depicting the example of the overall configuration of the reinforcing bar binding machine of the first embodiment.

A reinforcing bar binding machine 1A of the first embodiment includes a first body part 301, a second body part 302, and an elongated connecting part 303 configured to connect the first body part 301 and the second body part 302. The first body part 301 has a handle part 304*h* having a pair of grip parts 304L and 304R that can be grasped by an operator. A battery 310B is mounted to the first body part 301.

Figure 5:
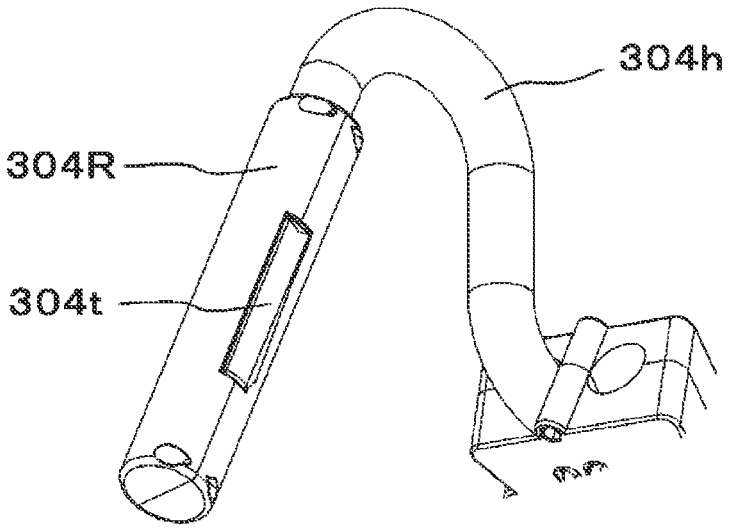
FIG. 5 is a perspective view depicting an example of a grip part.

FIG. 5 is a perspective view depicting an example of the grip part. The handle part 304*h* has an operation part 304*t* provided to the grip part 304R that is mainly grasped with a right hand. The operation part 304*t* is attached to the grip part 304R so as to be rotatable about a shaft (not shown) as a support point, and protrudes from a surface of the grip part 304R. The operation part 304*t* is grasped together with the grip part 304R by the operator, so that it is rotated with respect to the grip part 304R and is thus actuated. The reinforcing bar binding machine 1A includes an output unit configured to perform a predetermined output as the operation part 304*t* is actuated, and provided in the grip part 304R. The output unit configured to perform a predetermined output as the operation part 304*t* is actuated is referred to as a first output unit, which will be described later.

Figure 6:
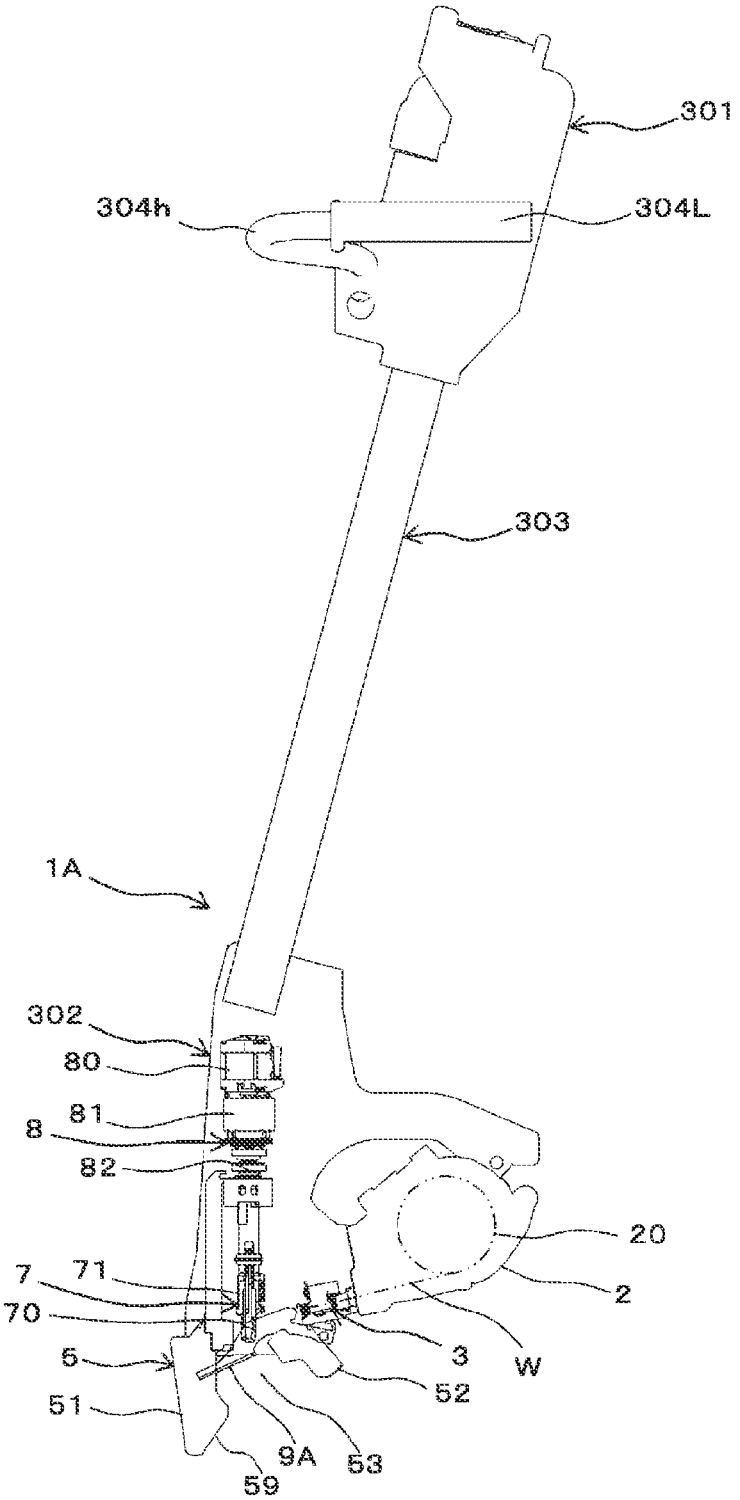
FIG. 6 is a side view depicting an example of an internal configuration of the reinforcing bar binding machine of the first embodiment.
Figure 7:
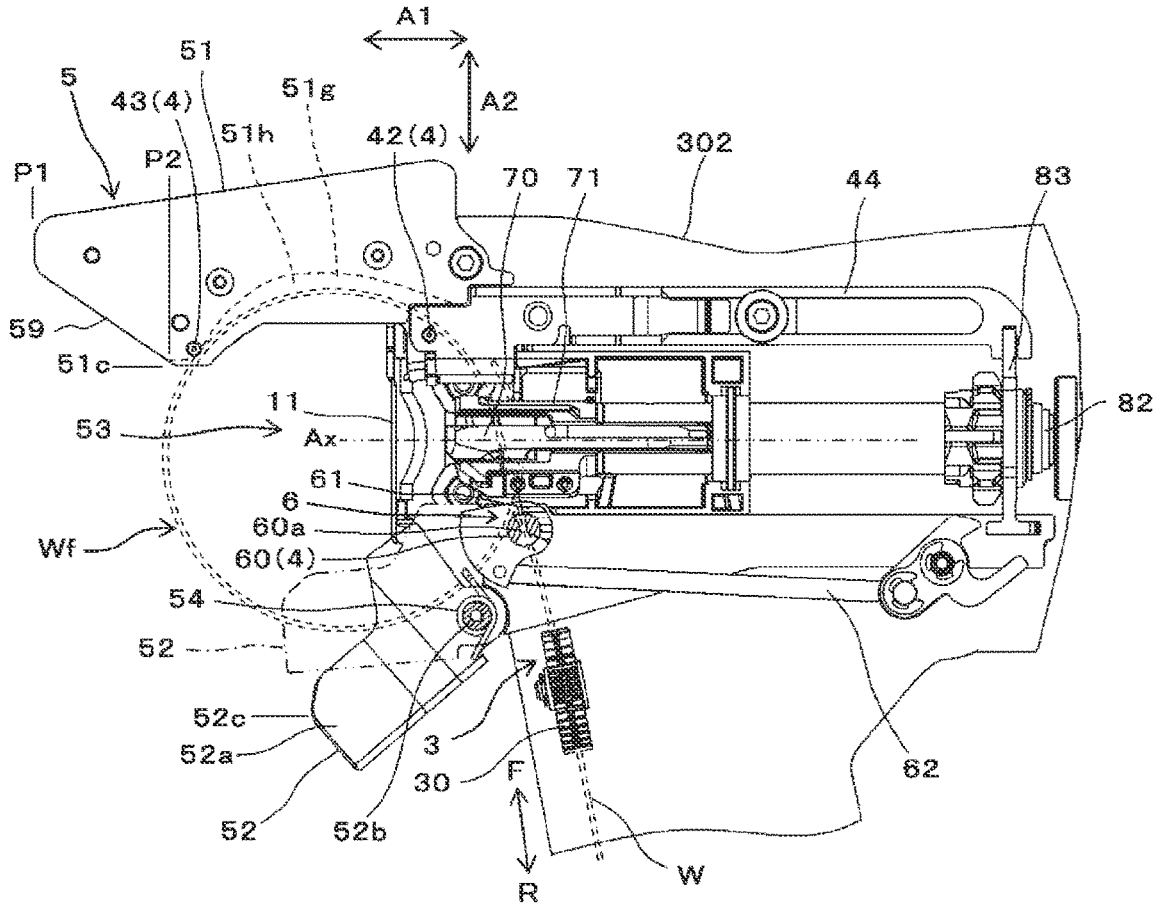
FIG. 7 is a side view depicting main parts of the internal configuration of the reinforcing bar binding machine of the first embodiment.

FIG. 6 is a side view depicting an example of an internal configuration of the reinforcing bar binding machine of the first embodiment, and FIG. 7 is a side view depicting main parts of the internal configuration of the reinforcing bar binding machine of the first embodiment.

The second body part 302 has an accommodation part 2 configured to rotatably accommodate a wire reel 20 on which the wire W is wound, and a feeding unit 3 configured to feed the wire W wound on the wire reel 20 accommodated in the accommodation part 2. The second body part 302 also has a regulation part 4 configured to curl the wire W fed by the feeding unit 3, and a guide part 5 configured to guide the wire W curled by the regulation part 4 to a surrounding of reinforcing bars S, which are a binding object. The second body part 302 also has a cutting unit 6 configured to cut the wire W, a twisting unit 7 configured to twist the wire W, and a drive unit 8 configured to drive the cutting unit 6, the twisting unit 7, and the like.

In the reinforcing bar binding machine 1A, the guide part 5 is provided on one side of the second body part 302. In the present embodiment, the side on which the guide part 5 is provided is defined as the front. In the reinforcing bar binding machine 1A, the first body part 301 and the second body part 302 are connected by the connecting part 303, so that the guide part 5 and the handle part 304*h* are extended therebetween, as compared to a reinforcing bar binding machine with no connecting part 303.

The accommodation part 2 is configured so that the wire reel 20 can be attached/detached and supported. The feeding unit 3 has a pair of feeding gears 30 as a feeding member. When a motor (not shown) rotates the feeding gears 30 in a state where the wire W is sandwiched between the pair of feeding gears 30, the feeding unit 3 feeds the wire W. The feeding unit 3 can feed the wire W in a forward direction denoted with an arrow F and in a reverse direction denoted with an arrow R, according to a rotating direction of the feeding gears 30.

The cutting unit 6 is provided downstream of the feeding unit 3 with respect to the feeding of the wire W in the forward direction denoted with the arrow F. The cutting unit 6 has a fixed blade part 60, and a movable blade part 61 configured to cut the wire W in cooperation with the fixed blade part 60. The cutting unit 6 also has a transmission mechanism 62 configured to transmit motion of the drive unit 8 to the movable blade part 61.

The fixed blade part 60 has an opening 60*a* through which the wire W passes. The movable blade part 61 is configured to cut the wire W passing through the opening 60*a* of the fixed blade part 60 by a rotating operation about the fixed blade part 60 as a support point.

The regulation part 4 has a first regulation member to a third regulation member in contact with the wire W at a plurality of parts, in the present example, at least three places in a feeding direction of the wire W fed by the feeding unit 3, thereby curling the wire W along a feeding path Wf of the wire W shown with the broken line in FIG. 7.

The first regulation member of the regulation part 4 is constituted by the fixed blade part 60. The regulation part 4 also has a regulation member 42 as the second regulation member provided downstream of the fixed blade part 60 with respect to the feeding of the wire W in the forward direction denoted with the arrow F, and a regulation member 43 as the third regulation member provided downstream of the regulation member 42. The regulation member 42 and the regulation member 43 are each constituted by a cylindrical member, and the wire W is in contact with outer peripheral surfaces thereof.

In the regulation part 4, the fixed blade part 60, the regulation member 42 and the regulation member 43 are arranged on a curve in conformity to the spiral feeding path Wf of the wire W. The opening 60*a* of the fixed blade part 60 through which the wire W passes is provided on the feeding path Wf of the wire W. The regulation member 42 is provided on a diametrically inner side with respect to the feeding path Wf of the wire W. The regulation member 43 is provided on a diametrically outer side with respect to the feeding path Wf of the wire W.

Thereby, the wire W fed by the feeding unit 3 passes in contact with the fixed blade part 60, the regulation member 42 and the regulation member 43, so that the wire W is curled to follow the feeding path Wf of the wire W.

The regulation part 4 has a transmission mechanism 44 configured to transmit motion of the drive unit 8 to the regulation member 42. In operations of feeding the wire W in the forward direction by the feeding unit 3 and curling the wire W, the regulation member 42 is configured to move to a position at which it contacts the wire W, and in operations of feeding the wire W in the reverse direction and winding the wire W on the reinforcing bars S, the regulation member 42 is configured to move to a position at which it does not contact the wire W.

Figure 8A:
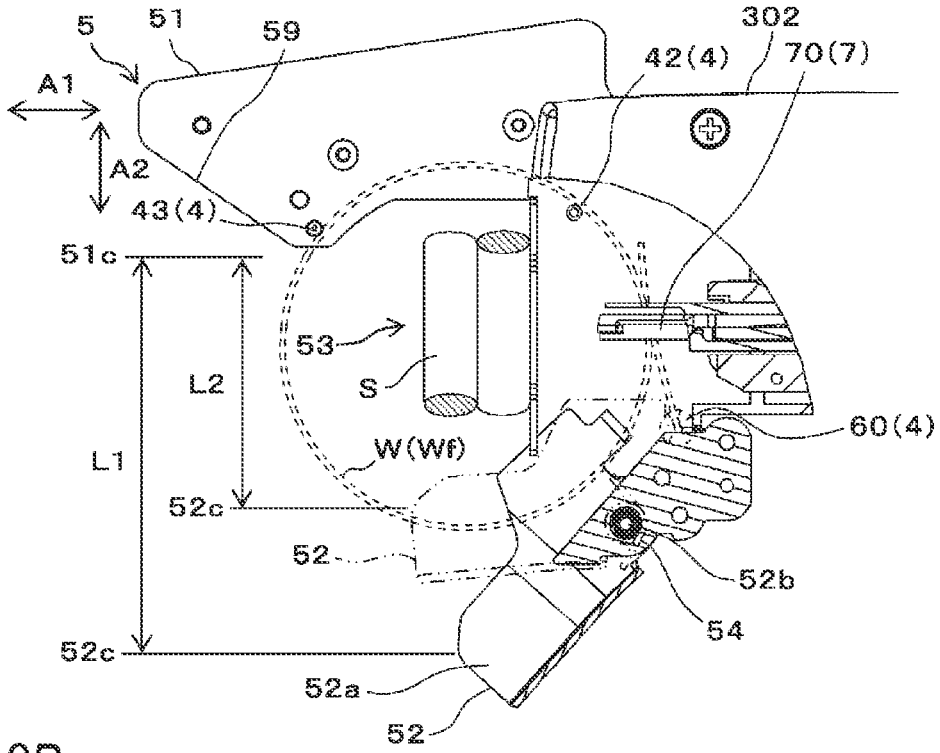
FIG. 8A is a side view depicting an example of a guide part.
Figure 8B:
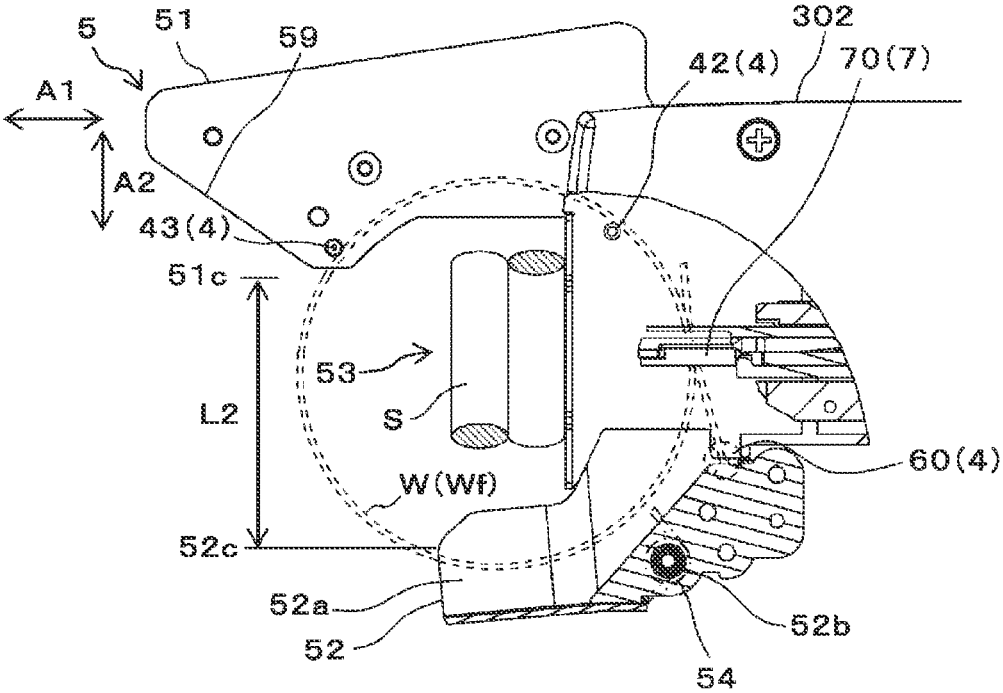
FIG. 8B is a side view depicting the example of the guide part.
Figure 9:
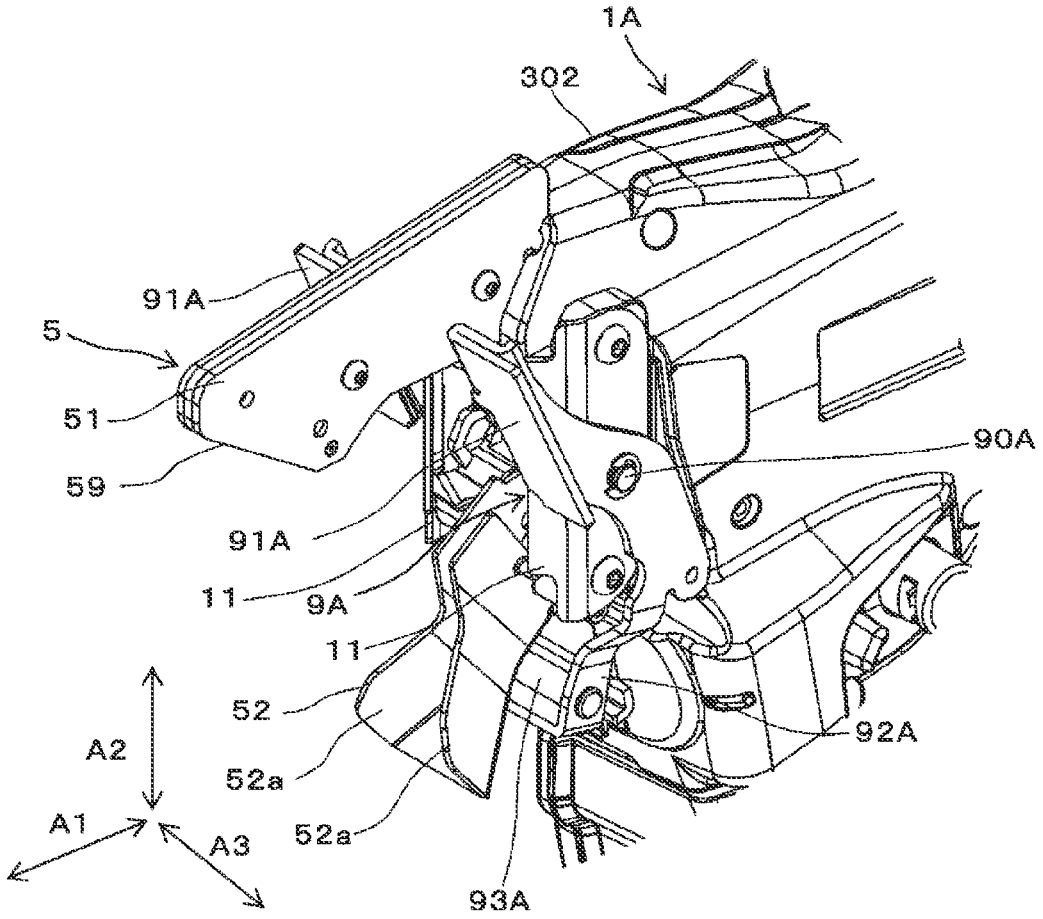
FIG. 9 is a perspective view depicting an example of the guide part and a contact member.
Figure 10A:
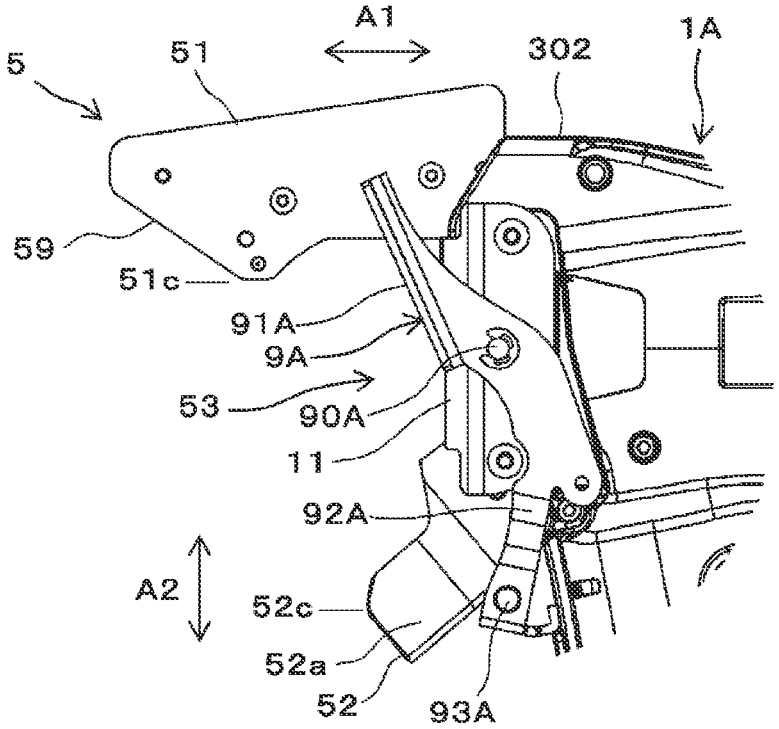
FIG. 10A is a side view depicting an example of the contact member.
Figure 10B:
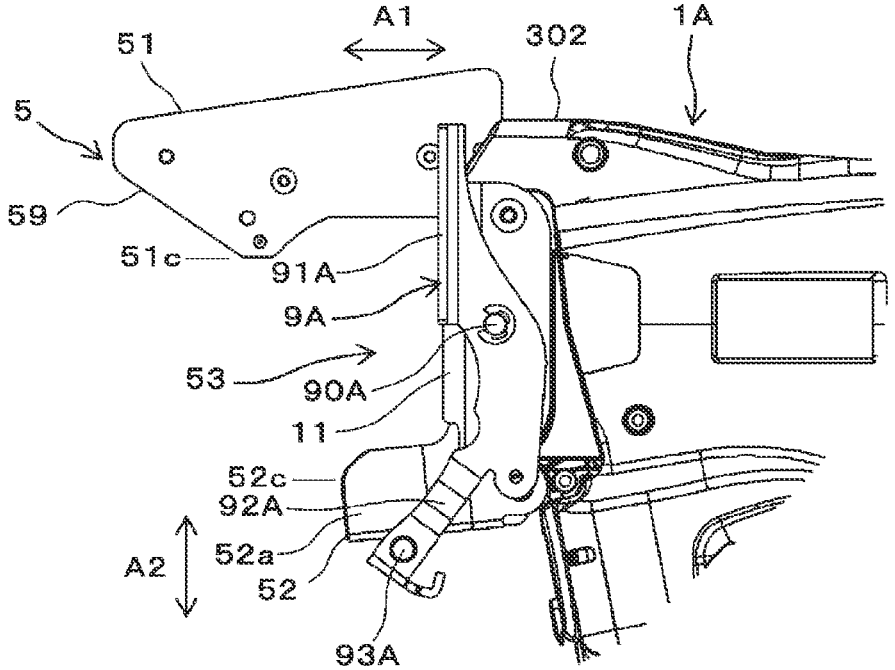
FIG. 10B is a side view depicting the example of the contact member.

FIGS. 8A and 8B are side views depicting an example of the guide part, FIG. 9 is a perspective view depicting an example of the guide part and a contact member, and FIGS. 10A and 10B are side views depicting an example of the contact member. In the below, a configuration of actuating a pair of guides and operational effects are described.

The guide part 5 has a first guide 51 provided with the regulation member 43 of the regulation part 4, and a second guide 52 configured to guide the wire W curled by the regulation part 4 and the first guide 51 to the twisting unit 7.

The first guide 51 is attached to an end portion on a front side of the second body part 302, and extends in a first direction denoted with an arrow A1. As shown in FIG. 7, the first guide 51 has a groove portion 51*h* having a guide surface 51*g* with which the wire W fed by the feeding unit 3 is in sliding contact. As for the first guide 51, when a side attached to the second body part 302 is referred to as a base end-side and a side extending in the first direction from the second body part 302 is referred to as a tip end-side, the regulation member 42 is provided to the base end-side of the first guide 51 and the regulation member 43 is provided to the tip end-side of the first guide 51. A gap through which the wire W can pass is formed between the guide surface 51*g* of the first guide 51 and the outer peripheral surface of the regulation member 42. A part of the outer peripheral surface of the regulation member 43 protrudes toward the guide surface 51*g* of the first guide 51.

The second guide 52 is attached to an end portion on the front side of the second body part 302. The second guide 52 is provided facing the first guide 51 in a second direction orthogonal to the first direction and denoted with an arrow A2. The first guide 51 and the second guide 52 are spaced by a predetermined interval in the second direction, and an insertion/pulling-out opening 53 in and from which the reinforcing bars S are inserted/pulled out is formed between the first guide 51 and the second guide 52, as shown in FIGS. 8A and 8B.

The guide part 5 has an induction part 59 configured to guide the reinforcing bars S to the insertion/pulling-out opening 53. The induction part 59 is provided on the tip end-side of the first guide 51, and is provided with a surface along which an interval between the first guide 51 and the second guide 52 decreases from a tip end-side toward a base end-side of the induction part 59. Specifically, as shown in FIG. 7, the induction part 59 is constituted by an inclined surface inclined relative to the first direction denoted with the arrow A1 in a direction in which the interval between the first guide 51 and the second guide 52 decreases, from a tip end P1 of the first guide 51 toward a vicinity of the end portion P2 of the groove portion 51*h* on the tip end-side of the first guide 51.

As shown in FIG. 9, the second guide 52 has a pair of side guides 52*a* facing each other in a third direction denoted with an arrow A3 orthogonal to the first direction and the second direction. As for the second guide 52, when a side attached to the second body part 302 is referred to as a base end-side and a side extending in the first direction from the second body part 302 is referred to as a tip end-side, a gap between the pair of side guides 52*a* gradually decreases from the tip end-side toward the base end-side. In the pair of side guides 52*a*, the base end-sides face each other with a gap through which the wire W can pass.

The second guide 52 is attached to the second body part 302 with being supported on the base end-side by a shaft 52*b*. An axis line of the shaft 52*b* faces toward the third direction. The second guide 52 can rotate about the shaft 52*b* as a support point with respect to the second body part 302.

The second guide 52 can move in directions in which an end portion 52*c* on the tip end-side comes close to and gets away from an end portion 51*c* of the first guide 51 facing the second guide 52 in the second direction denoted with the arrow A2. The end portion P2 of the groove portion 51*h* is exposed to the end portion 51*c* of the first guide 51B.

The second guide 52 is configured to rotate about the shaft 52*b* as a support point, thereby moving between a first position (refer to the solid line in FIG. 8A) at which a distance between the end portion 52*c* of the second guide 52 and the end portion 51*c* of the first guide 51 is a first distance L1 and a second position (refer to the dashed-two dotted line in FIG. 8A and the solid line in FIG. 8B) at which the distance between the end portion 52*c* of the second guide 52 and the end portion 51*c* of the first guide 51 is a second distance L2 shorter than the first distance L1.

In a state where the second guide 52 is located at the second position, the end portion 52*c* of the second guide 52 and the end portion 51*c* of the first guide 51 are opened therebetween. In a state where the second guide 52 is located at the first position, the interval between the end portion 52*c* of the second guide 52 and the end portion 51*c* of the first guide 51 is larger, so that the reinforcing bars S can be more easily inserted into the insertion/pulling-out opening 53 between the first guide 51 and the second guide 52.

In the state where the second guide 52 is located at the second position, the side guides 52*a* are positioned on the feeding path Wf of the wire W shown with the broken line in FIGS. 8A and 8B. In the state where the second guide 52 is located at the first position, as long as the interval between the end portion 52*c* of the second guide 52 and the end portion 51*c* of the first guide 51 is greater than the case where the second guide 52 is located at the second position, the side guides 52*a* may be positioned on the feeding path Wf of the wire W or the side guides 52*a* may be positioned on an outermore side than the feeding path Wf of the wire W, as shown with the solid line in FIG. 8A.

The second guide 52 is urged in a moving direction to the first position by an urging member 54 such as a tortional coil spring and is held at the first position.

The reinforcing bar binding machine 1A includes a contact member 9A configured to detect the reinforcing bars S as the reinforcing bars S inserted in the insertion/pulling-out opening 53 between the first guide 51 and the second guide 52 are contacted thereto, and to actuate the second guide 52. The reinforcing bar binding machine 1A also includes a cover part 11 configured to cover the end portion on the front side of the second body part 302.

The cover part 11 is attached from the end portion on the front side of the second body part 302 over both left and right sides of the second body part 302 in the third direction. The cover part 11 is constituted by a metal plate or the like, and has a shape to cover a portion or all of the end portion on the front side of the second body part 302 and portions of both left and right sides on the front side of the second body part 302, between the base end-side of the first guide 51 and the base end-side of the second guide 52. While the second body part 302 is made of resin, the cover part 11 is made of metal, so that even when the contact member 9A and the reinforcing bars S are contacted to the cover part 11, the wear of the cover part 11 can be reduced.

The contact member 9A is rotatably supported by a shaft 90A and is attached to the second body part 302 via the cover part 11. The contact member 9A has a bent shape, and has contact parts 91A provided on one side with respect to the shaft 90A and to be contacted to the reinforcing bars S and a connecting part 92A provided on the other side with respect to the shaft 90A and connected to the second guide 52. Specifically, the contact parts 91A are provided on one side with respect to the shaft 90A in the second direction, and the connecting part 92A is provided on the other side.

The contact member 9A has the shaft 90A provided adjacent to a center between the first guide 51 and the second guide 52. The contact member 9A also has a pair of contact parts 91A in the third direction denoted with the arrow A3 with an interval, through which the wire W binding the reinforcing bars S can pass, from the vicinity of a part supported by the shaft 90A toward the first guide 51-side. The contact parts 91A extend to both left and right sides of the first guide 51.

The contact member 9A also has the connecting part 92A provided from the part supported by the shaft 90A toward the second guide 52-side, and a displacing part 93A in contact with a part on an opposite side to a side of the second guide 52 facing the first guide 51 is provided on a tip end-side of the connecting part 92A.

The contact member 9A is configured to rotate about the shaft 90A as a support point with respect to the second body part 302, so that the contact parts 91A move between a standby position (FIG. 10A) at which the contact parts 91A protrude from the cover part 11 into the insertion/pulling-out opening 53 and an actuation position (FIG. 10B) at which the contact parts 91A come close to the cover part 11.

In a state where the contact member 9A is moved to the actuation position shown in FIG. 10B, the contact member 9A has such a shape that the contact parts 91A extend from the shaft 90A toward the first guide 51 along the second direction denoted with the arrow A2. Therefore, the rotation of the contact member 9A about the shaft 90A as a support point causes the contact parts 91A to move in the first direction denoted with the arrow A1 along an arc whose center is the shaft 90A. During an operation of inserting the reinforcing bars S into the insertion/pulling-out opening 53 between the first guide 51 and the second guide 52, the reinforcing bar binding machine 1A is moved in the first direction denoted with the arrow A1. Due to the relative movement of the reinforcing bar binding machine 1A and the reinforcing bars S, the contact parts 91A are pushed by a force along the first direction denoted with the arrow A1, so that the contact member 9A is moved to the actuation position. Thereby, a moving direction of the contact parts 91A due to the rotation about the shaft 90A as a support point becomes a direction along the direction of the force by which the reinforcing bars S push the contact parts 91A by the relative movement of the reinforcing bar binding machine 1A and the reinforcing bars S. Also, in the state where the contact member is moved to the actuation position shown in FIG. 10B, the contact member 9A has such a shape that the connecting part 92A is tilted forward from the shaft 90A with respect to the contact parts 91A and extends toward the second guide 52. The rotation of the contact member 9A about the shaft 90A as a support point causes the displacing part 93A to move in the second direction denoted with the arrow A2 along an arc whose center is the shaft 90A. Thereby, in a state where the contact member 9A is urged by the urging member 54 and the second guide 52 is thus located at the first position, the displacing part 93A is pushed away from the first guide 51 by the second guide 52. For this reason, the contact member 9A is moved to the standby position by the rotation about the shaft 90A as a support point, so that the contact parts 91A protrude from the cover part 11. Note that, in the present example, the contact member 9A is configured to move by the force of the urging member 54 for urging the second guide 52. However, another urging member for urging the contact member 9A may also be provided.

When the contact parts 91A are pressed against the reinforcing bars S, the contact parts 91A are moved in the first direction. Thereby, the contact member 9A rotates about the shaft 90A as a support point and moves to the actuation position. When the contact member 9A is moved to the actuation position, the displacing part 93A is moved toward the first guide 51 by the rotation of the connecting part 92A about the shaft 90A as a support point. Thereby, the displacing part 93A pushes the second guide 52, so that the second guide 52 is moved to the second position. In this way, the contact of the reinforcing bars S to the contact parts 91A and the movement of the displacing part 93A cause the second guide 52 to move from the first position to the second position.

Figure 11:
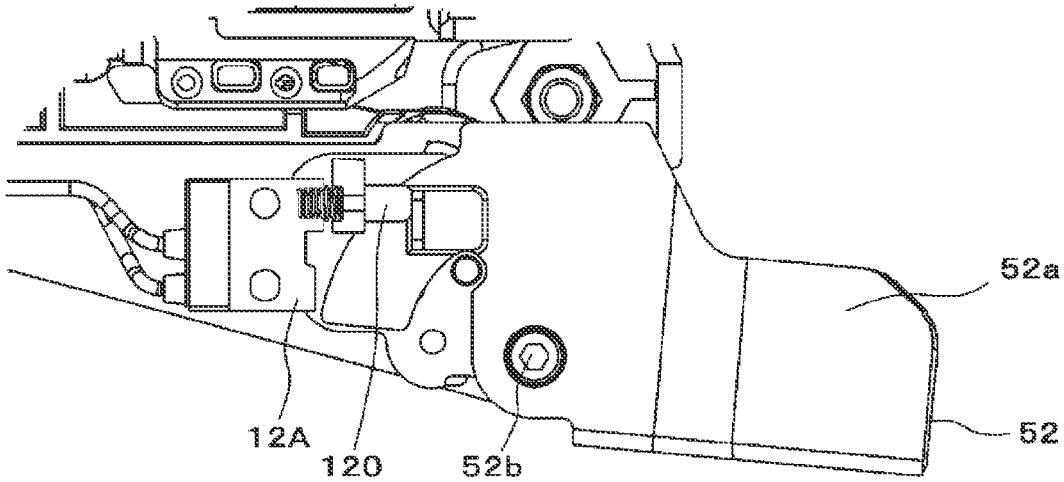
FIG. 11 is a side view depicting an example of a switch configured to detect a second guide.

FIG. 11 is a side depicting an example of an output unit configured to detect the second guide. In the below, a second output unit 12A is described in detail with reference to each drawing. The reinforcing bar binding machine 1A includes a second output unit 12A configured to detect that the second guide 52 is moved to the second position, thereby performing a predetermined output. The second output unit 12A has a configuration where an output thereof changes by displacement of a movable element 120, for example. In the present example, when the contact member 9A is moved to the standby position and the second guide 52 is thus moved to the first position, the second guide 52 is moved away from the movable element 120. In this way, in a state where the second guide 52 is moved to the first position, an output of the second output unit 12A is set to an off state. In contrast, when the contact member 9A is moved to the actuation position and the second guide 52 is thus moved to the second position, the second guide 52 is moved in a direction of pushing the movable element 120. In this way, in a state where the second guide 52 is moved to the second position, an output of the second output unit 12A is set to an on state. Note that, the output unit configured to detect the second guide may be constituted by a non-contact sensor. Further, instead of the output unit configured to detect the second guide, an output unit configured to detect that the contact member is moved to the actuation position may be provided.

Subsequently, the twisting unit 7 and the drive unit 8 are described with reference to each drawing. The twisting unit 7 includes an engaging part 70 to which the wire W is engaged, and an actuation part 71 configured to actuate the engaging part 70. The engaging part 70 is configured to rotate by an operation of the actuation part 71, thereby twisting the wire W wound on the reinforcing bars S.

The drive unit 8 includes a twisting motor 80 configured to drive the twisting unit 7 and the like, a decelerator 81 configured to perform deceleration and torque amplification, a rotary shaft 72 configured to drive and rotate via the decelerator 81 by the twisting motor 80, and a movable member 83 configured to transmit a drive force to the cutting unit 6 and the regulation member 42. The twisting unit 7 and the drive unit 8 are arranged so that centers of rotation of the rotary shaft 82, the actuation part 71 and the engaging part 70 are on the same axis. The centers of rotation of the rotary shaft 82, the actuation part 71 and the engaging part 70 are referred to as an axis line Ax.

The engaging part 70 is formed with a first passage through which the wire W fed to the cutting unit 6 by the feeding unit 3 passes, and a second passage through which the wire W curled by the regulation part 4 and guided to the twisting unit 7 by the guide part 5 passes.

The drive unit 8 is configured to move the actuation part 71 along an axis direction of the rotary shaft 82 by a rotating operation of the rotary shaft 82. The actuation part 71 is moved along the axis direction of the rotary shaft 82, so that the engaging part 70 holds a tip end-side of the wire W guided to the twisting unit 7 by the guide part 5.

In the drive unit 8, the movable member 83 is configured to move along the axis direction of the rotary shaft 82 in conjunction with the moving operation of the actuation part 71 along the axis direction of the rotary shaft 82, so that the motion of the movable member 83 is transmitted to the regulation member 42 by the transmission mechanism 44 and the regulation member 42 is thus moved to a position at which it does not contact the wire. In addition, the actuation part 71 is configured to move along the axis direction of the rotary shaft 82, so that the motion of the movable member 83 is transmitted to the movable blade part 61 by the transmission mechanism 62 and the movable blade part 61 is thus actuated to cut the wire W.

The drive unit 8 is configured to rotate the actuation part 71 moved along the axis direction of the rotary shaft 82 by the rotating operation of the rotary shaft 82. The actuation part 71 is configured to rotate about the axis of the rotary shaft 82, thereby twisting the wire W by the engaging part 70.

Figure 12:
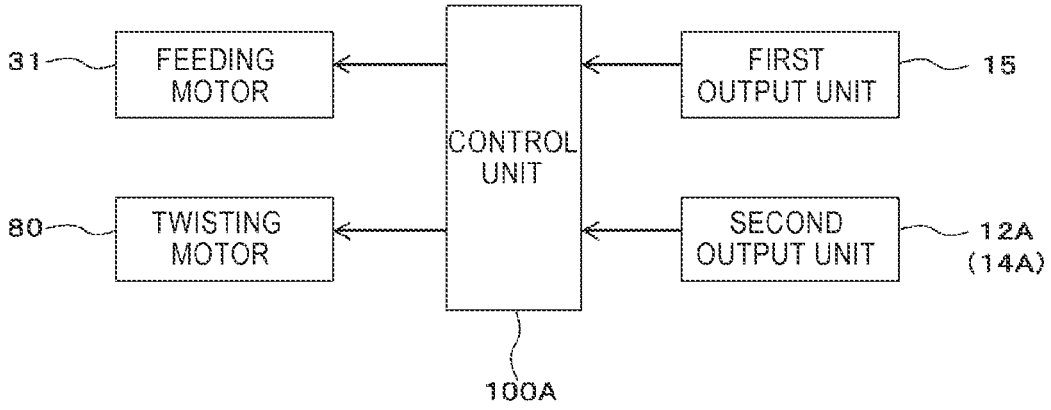
FIG. 12 is a functional block diagram of the reinforcing bar binding machine of the first embodiment.

FIG. 12 is a functional block diagram of the reinforcing bar binding machine of the first embodiment. In the reinforcing bar binding machine 1A, a control unit 100A is configured to detect outputs of a first output unit 15 configured to be actuated as the operation part 304*t* is operated and a second output unit 12A configured to be actuated as the reinforcing bars S are contacted to the contact parts 91A of the contact member 9A and the reinforcing bars S are pressed. The control unit 100A is configured to control the feeding motor 31 configured to drive the feeding gears 30 and the twisting motor 80 configured to drive the twisting unit 7 and the like, in response to the outputs of the first output unit 15 and the second output unit 12A, thereby executing a series of operations of binding the reinforcing bars S with the wire W.

Figure 13:
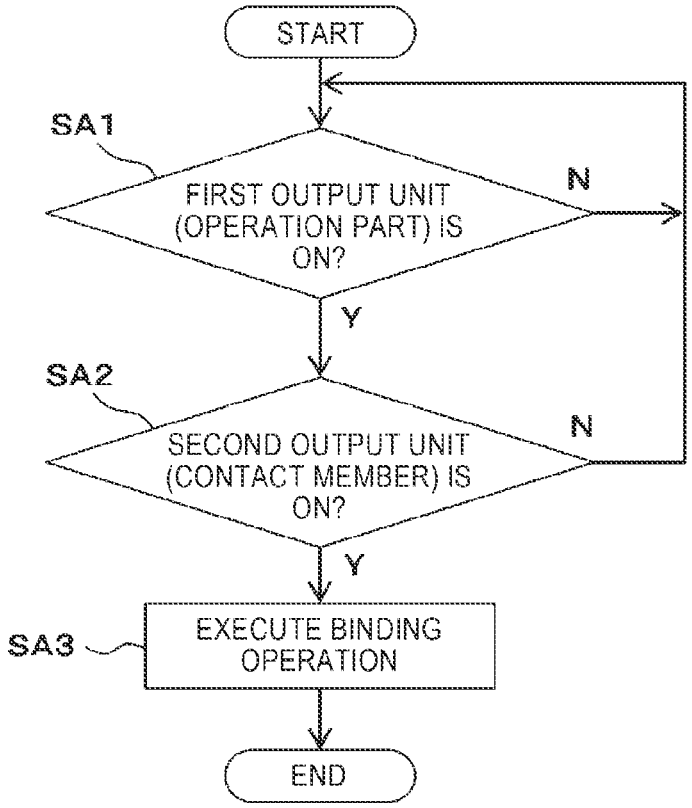
FIG. 13 is a flowchart depicting an example of operations of the reinforcing bar binding machine of the first embodiment.

FIG. 13 is a flowchart depicting an example of operations of the reinforcing bar binding machine 1A of the first embodiment. Subsequently, operations of binding the reinforcing bars S with the wire W by the reinforcing bar binding machine 1A are described. The operator grips the handle part 304*h* of the reinforcing bar binding machine 1A with both hands. That is, the operator grasps the grip part 304R of the handle part 304*h* with a right hand and grasps the grip part 304L of the handle part 304*h* with a left hand.

When the operation part 304*t* is grasped together with the grip part 304R by the operator, the operation part 304*t* rotates with respect to the grip part 304R and is thus actuated. When the operation part 304*t* is actuated, the output of the first output unit 15 becomes on and the control unit 100A detects that the output of the first output unit 15 becomes on, in step SA1 of FIG. 13. Note that, the operation that the control unit 100A detects that the output of the first output unit 15 becomes on is also referred to as 'the control unit detects the first signal'.

The operator grips the handle part 304*h* of the reinforcing bar binding machine 1A with both hands, aligns a position of the guide part 5 with an intersection point of the two reinforcing bars S, and inserts the reinforcing bars S into the insertion/pulling-out opening 53.

In order to bind the reinforcing bars S at the feet of the operator, the reinforcing bar binding machine 1A is used with the guide part 5 facing downward in a state where the operator stands. For this reason, it is difficult to align the position of the guide part 5 with the intersection point of the two reinforcing bars S. Therefore, in the reinforcing bar binding machine 1A, in a state where the reinforcing bars S are not inserted in the insertion/pulling-out opening 53, as shown in FIG. 10A, the second guide 52 is moved to the first position, so that the interval between the end portion 52*c* of the second guide 52 and the end portion 51*c* of the first guide 51 increases. The reinforcing bar binding machine 1A also includes the induction part 59 provided on the tip end-side of the first guide 51 and having a shape capable of guiding the reinforcing bars S into the insertion/pulling-out opening 53. The operator can bring the reinforcing bars S into contact with the induction part 59 and move the induction part 59 on the reinforcing bars S in a sliding manner. Thereby, the reinforcing bars S can be more easily inserted into the insertion/pulling-out opening 53.

The operator presses the reinforcing bars S against the contact parts 91A of the contact member 9A by the operation of moving the reinforcing bar binding machine 1A in the direction in which the reinforcing bars S are inserted into the insertion/pulling-out opening 53.

Due to the operation of moving the reinforcing bar binding machine 1A in the direction of inserting the reinforcing bars S into the insertion/pulling-out opening 53, the contact member 9A is applied with a force along the moving direction of the reinforcing bar binding machine 1A, so that the contact parts 91A are pushed. Thereby, the contact parts 91A are moved in the first direction denoted with the arrow A1, so that the contact member 9A rotates about the shaft 90A as a support point, thereby moving to the actuation position, as shown in FIG. 10B.

When the two intersecting reinforcing bars S are inserted into the insertion/pulling-out opening 53, one reinforcing bar S is located at one side part of the first guide 51 and the other reinforcing bar S is located at the other side part of the first guide 51. In contrast, the pair of contact parts 91A of the contact member 9A extends from between the first guide 51 and the second guide 52 toward both left and right sides of the first guide 51. Thereby, the reinforcing bars S inserted in the insertion/pulling-out opening 53 are securely contacted to the contact parts 91A, so that the contact member 9A can be moved to the actuation position.

In addition, the contact parts 91A of the contact member 9A are moved in the first direction denoted with the arrow A1 by the rotating operation about the shaft 90A as a support point. Thereby, the contact parts 91A can be pushed by the operation of moving the reinforcing bar binding machine 1A in the direction of inserting the reinforcing bars S into the insertion/pulling-out opening 53, and it is not necessary to move the reinforcing bar binding machine 1A in another direction so as to actuate the contact member 9A.

When the contact member 9A is moved to the actuation position, the rotation of the connecting part 92A about the shaft 90A as a support point causes the displacing part 93A to push the second guide 52 toward the first guide 51, so that the second guide 52 is moved to the second position.

When the second guide 52 is moved to the second position, the output of the second output unit 12A becomes on and the control unit 100A detects that the output of the second output unit 12A becomes on, in step SA2 of FIG. 13. Note that, the operation that the control unit 100A detects that the output of the second output unit 12A becomes on is also referred to as 'the control unit detects the second signal'. In a state where the contact member 9A is moved to the actuation position and thus the output of the second output unit 12A becomes on, the reinforcing bars S are in a state where the reinforcing bars are within the feeding path Wf of the wire W shown with the broken line in FIG. 7 and are inserted to a bindable position. Thereby, the second output unit 12A can detect that the reinforcing bars S are inserted in the feeding path Wf of the wire W.

When it is detected that the output of the second output unit 12A becomes on, i.e., the second signal is detected, in a state where it is detected that the output of the first output unit 15 becomes on, i.e., in a state where the first signal is detected, the control unit 100A controls the feeding motor 31 and the twisting motor 80 to execute a series of operations of binding the reinforcing bars S with the wire W, in step SA3 of FIG. 13. Note that, the contact member 9A is pressed against the reinforcing bars S and is moved to the actuation position and thus the output of the second output unit 12A becomes on, in a state where the output of the first output unit 15 is off, and even when it is detected that the output of the first output unit 15 becomes on after the output of the second output unit 12A becomes on, the control unit 100A does not start the drive of the feeding motor 31 and the twisting motor 80, and does not execute the binding operation.

Thereby, after the grip part 304R is grasped, so that the operation part 304*t* is operated and the output of the first output unit 15 becomes on, the control unit 100A does not start the drive of the feeding motor 31 and the twisting motor 80 unless the contact member 9A is pressed against the reinforcing bars S and is thus moved to the actuation position and the output of the second output unit 12A becomes on, in a state where the output of the first output unit 15 becomes on, i.e., in a state where the grip part 304R is grasped.

The binding operation is described in detail. The feeding motor 31 is rotated in the forward direction and the feeding gears 30 are thus rotated in the forward direction, so that the wire W is fed in the forward direction denoted with the arrow F. The wire W fed in the forward direction by the feeding unit 3 passes through the fixed blade part 60, which is the first regulation member constituting the regulation part 4, and the regulation member 42 that is the second regulation member. The wire W having passed through the regulation member 42 is contacted to the guide surface 51*g* of the first guide 51 and is thus guided to the regulation member 43 that is the third regulation member.

Thereby, the wire W fed in the forward direction by the feeding unit 3 is contacted to the fixed blade part 60, the regulation member 42, the regulation member 43, and the guide surface 51*g* of the first guide 51 and is thus bent into an arc shape. Then, the wire W fed in the forward direction by the feeding unit 3 is contacted to the fixed blade part 60 and the regulation member 43 from an outer periphery direction of the arc shape and is contacted to the regulation member 42 between the fixed blade part 60 and the regulation member 43 from an inner periphery direction of the arc shape, so that a substantially circular curl is formed.

The end portion 51*c* of the first guide 51 and the end portion 52*c* of the second guide 52 are spaced by a predetermined interval in a state where the second guide 52 is moved to the second position. However, in the state where the second guide 52 is moved to the second position, the pair of side guides 52*a* is positioned on the feeding path Wf of the wire W, and the wire W fed in the forward direction by the feeding unit 3 is curled by the regulation part 4, as described above, so that the wire is guided between the pair of side guides 52*a* of the second guide 52.

The wire W guided between the pair of side guides 52*a* of the second guide 52 is fed in the forward direction by the feeding unit 3, so that the wire is guided to the engaging part 70 of the twisting unit 7 by the pair of side guides 52*a* of the second guide 52. Then, when it is determined that a tip end portion of the wire W is fed to a predetermined position, the control unit 100A stops the drive of the feeding motor 31. Thereby, the wire W is spirally wound around the reinforcing bars S. Note that, in a state where the second guide 52 is not moved to the second position and the output of the second output unit 12A is off, the control unit 100A does not perform the feeding of the wire W. Thereby, the wire W is not engaged to the engaging part 70 of the twisting unit 7, and occurrence of poor feeding is suppressed.

After stopping the feeding of the wire W in the forward direction, the control unit 100A rotates the twisting motor 80 in the forward direction. The twisting motor 80 is rotated in the forward direction, so that the engaging part 70 is actuated by the actuation part 71 and the tip end-side of the wire W is held by the engaging part 70.

When it is determined that the twisting motor 80 is rotated until the wire W is held by the engaging part 70, the control unit 100A stops the rotation of the twisting motor 80, and rotates the feeding motor 31 in the reverse direction. When the twisting motor 80 is rotated until the wire W is held by the engaging part 70, the motion of the movable member 83 is transmitted to the regulation member 42 by the transmission mechanism 44, so that the regulation member 42 is moved to a position at which it is not contacted to the wire.

When the feeding motor 31 is rotated in the reverse direction, the feeding gears 30 are rotated in the reverse direction, so that the wire W is fed in the reverse direction denoted with the arrow R. By the operation of feeding the wire W in the reverse direction, the wire W is wound closely contacted to the reinforcing bars S.

When it is determined that the feeding motor 31 is rotated in the reverse direction until the wire W is wound on the reinforcing bars S, the control unit 100A stops the rotation of the feeding motor 31, and then rotates the twisting motor 80 in the forward direction. The twisting motor 80 is rotated in the forward direction, so that the movable blade part 61 is actuated via the transmission mechanism 62 by the movable member 83 and the wire W is thus cut.

After the wire W is cut, the twisting motor 80 is continuously rotated in the forward direction, thereby rotating the engaging part 70 to twist the wire W.

When it is determined that the twisting motor 80 is rotated in the forward direction until the wire W is twisted, the control unit 100A rotates the twisting motor 80 in the reverse direction. The twisting motor 80 is rotated in the reverse direction, so that the engaging part 70 is returned to the initial position and the held state of the wire W is thus released. Thereby, the wire W binding the reinforcing bars S can be pulled out from the engaging part 70.

When it is determined that the twisting motor 80 is rotated in the reverse direction until the engaging part 70 and the like are returned to the initial position, the control unit 100A stops the rotation of the twisting motor 80.

The operator moves the reinforcing bar binding machine 1A in a direction of pulling out the reinforcing bars S bound with the wire W from the insertion/pulling-out opening 53. When the force of pushing the contact parts 91A of the contact member 9A is not applied by the operation of moving the reinforcing bar binding machine 1A in the direction of pulling out the reinforcing bars S from the insertion/pulling-out opening 53, the second guide 52 is moved from the second position to the first position by the force of the urging member 54.

When the second guide 52 is moved to the first position, the contact member 9A is pushed in a direction in which the displacing part 93A gets away from the first guide 51, and is moved to the standby position by the rotation about the shaft 90A as a support point, so that the contact parts 91A protrude from the cover part 11.

The operator's operation of moving the reinforcing bar binding machine 1A in the direction of pulling out the reinforcing bars S bound with the wire W from the insertion/pulling-out opening 53 causes the second guide 52 to move to the first position, so that the interval between the end portion 52*c* of the second guide 52 and the end portion 51*c* of the first guide 51 increases. Thereby, the reinforcing bars S can be more easily pulled out from the insertion/pulling-out opening 53.

Figure 14:
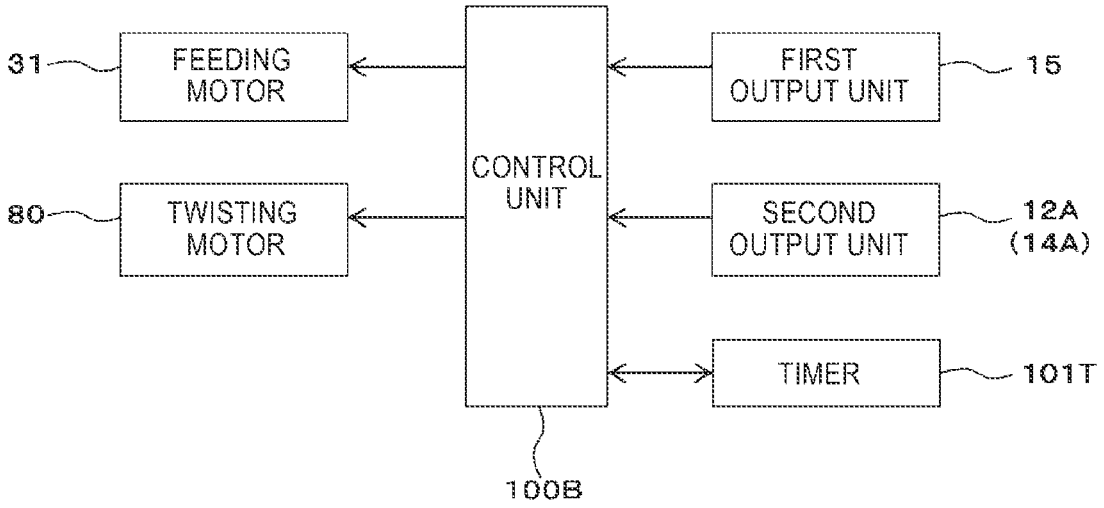
FIG. 14 is a functional block diagram of a modified embodiment of the reinforcing bar binding machine of the first embodiment.

FIG. 14 is a functional block diagram of a modified embodiment of the reinforcing bar binding machine of the first embodiment. When the grip part 304R is grasped and it is thus detected that the output of the first output unit 15 becomes on as the operation part 304*t* is thus actuated, the control unit 100B performs time measurement by a timer 101T, and executes control of regarding that the output of the first output unit 15 is on, for a predetermined time.

Figure 15:
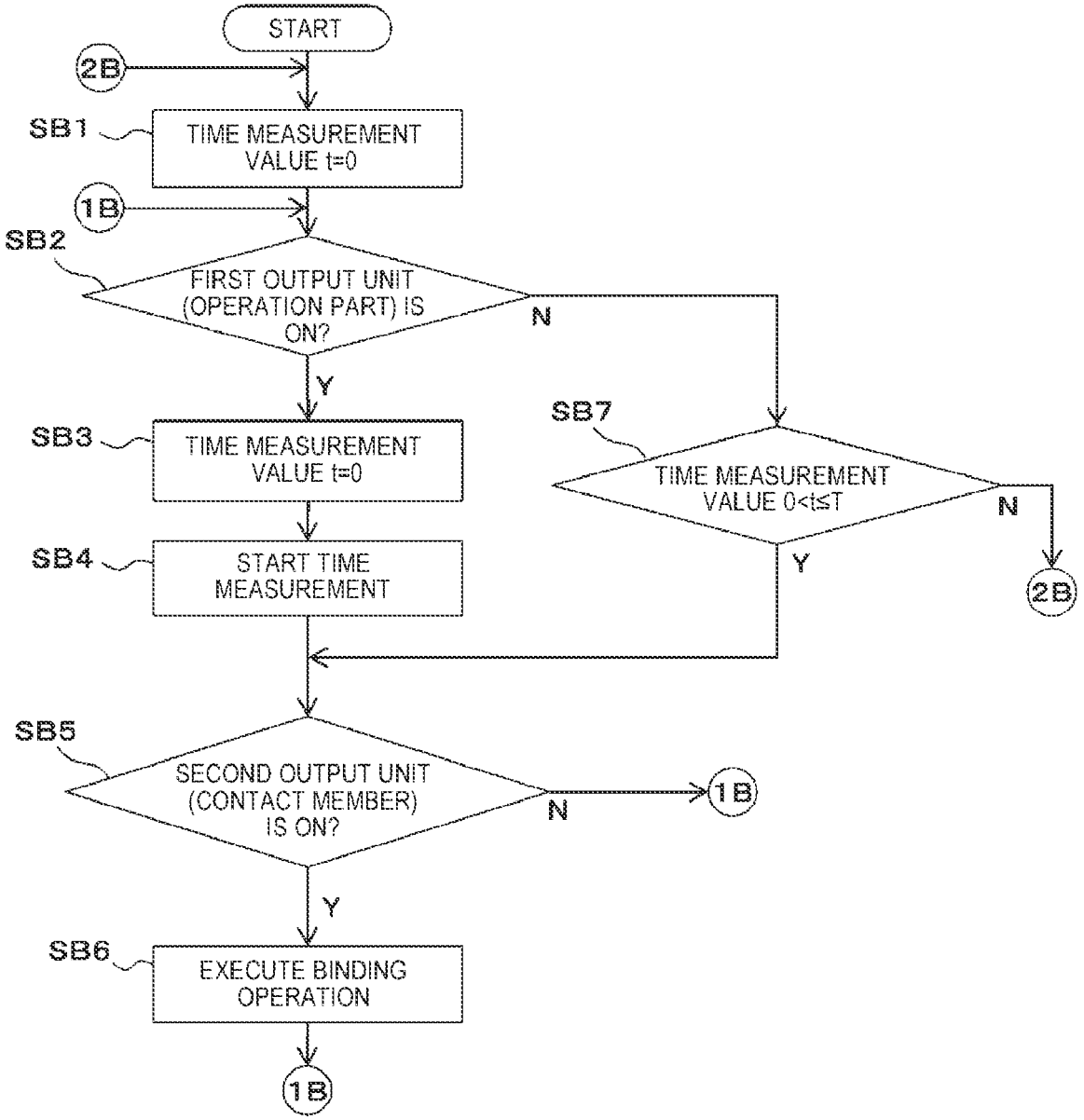
FIG. 15 is a flowchart depicting an example of operations of the modified embodiment of the reinforcing bar binding machine of the first embodiment.

FIG. 15 is a flowchart depicting an example of operations of the modified embodiment of the reinforcing bar binding machine of the first embodiment.

In step SB1 of FIG. 15, the control unit 100B sets a time measurement value t of the timer 101T to 0 (zero), and determines whether it is detected that the output of the first output unit 15 is on, in step SB2.

The operator grips the handle part 304*h* of the reinforcing bar binding machine 1A with both hands. That is, the operator grasps the grip part 304R of the handle part 304*h* with a right hand, and grasps the grip part 304L of the handle part 304*h* with a left hand.

When the operation part 304*t* is gripped together with the grip part 304R by the operator, the operation part 304*t* is rotated with respect to the grip part 304R and is thus actuated. When the operation part 304*t* is actuated, the output of the first output unit 15 becomes on and the control unit 100B detects that the output of the first output unit 15 is on, in step SB2 of FIG. 15. When it is detected that the output of the first output unit 15 is on, i.e., when it is determined the first signal is detected, the control unit 100B sets the time measurement value t of the timer 101T to 0 (zero) in step SB3, and starts time measurement by the timer 101T in step SB4.

The operator grips the handle part 304*h* of the reinforcing bar binding machine 1A with both hands, aligns the position of the guide part 5 with the intersection point of the two reinforcing bars S, and inserts the reinforcing bars S into the insertion/pulling-out opening 53. The operator presses the reinforcing bars S against the contact parts 91A of the contact member 9A by an operation of moving the reinforcing bar binding machine 1A in the direction of inserting the reinforcing bars S into the insertion/pulling-out opening 53.

By the operation of moving the reinforcing bar binding machine 1A in the direction of inserting the reinforcing bars S into the insertion/pulling-out opening 53, the contact member 9A is applied with a force along the moving direction of the reinforcing bar binding machine 1A, so that the contact parts 91A are pushed. Thereby, the contact parts 91A are moved in the first direction denoted with the arrow A1, so that the contact member 9A rotates about the shaft 90A as a support point, thereby moving to the actuation position, as shown in FIG. 10B.

When the contact member 9A is moved to the actuation position, the rotation of the connecting part 92A about the shaft 90A as a support point causes the displacing part 93A to push the second guide 52 toward the first guide 51, so that the second guide 52 is moved to the second position.

When it is detected that the output of the first output unit 15 becomes on, i.e., when the first signal is detected, the control unit 100B determines, in step SBS, whether it is detected that the output of the second output unit 12A is on. When it is determined in step SB5 that it is detected that the output of the second output unit 12A is off, the control unit 100B returns to step SB2.

When the second guide 52 is moved to the second position, the output of the second output unit 12A becomes on and the control unit 100B detects that the output of the second output unit 12A is on, in step SB5 of FIG. 15.

When it is detected that the output of the second output unit 12A is on, i.e., when the second signal is detected, in step SB5 of FIG. 15, the control unit 100B controls the feeding motor 31 and the twisting motor 80 to execute a series of operations of binding the reinforcing bars S with the wire W, in step SB6.

After executing the binding operation, the control unit 100B returns to step SB2 to determine whether it is detected that the output of the first output unit 15 is on. As described above, when the operation part 304*t* is actuated and thus the output of the first output unit 15 becomes on, the time measurement by the timer 101T is enabled to start. Thereby, when the output of the first output unit 15 becomes off after the output of the first output unit 15 becomes on, the time measurement by the timer 101T is performed. For example, the grip part 304R is grasped by the operator and the operation part 304*t* is actuated, so that the output of the first output unit 15 becomes on. Thereafter, the output of the first output unit 15 may become off because the grasping position of the grip part 304R deviates during the operation, for example. In this case, the output of the first output unit 15 becomes on, so that the time measurement by the timer 101T is performed.

Therefore, when it is determined in step SB2 that it is detected that the output of the first output unit 15 is off, the control unit 100B determines in step SB7 whether the time measurement value t by the timer 101T is within a predetermined time T.

When it is determined in step SB7 that the time measurement value t by the timer 101T is greater than 0 second and equal to or less than T and is within the predetermined time T, the control unit 100B determines in step SB5 whether it is detected that the output of the second output unit 12A is on. When it is determined in step SB5 that it is detected that the output of the second output unit 12A is on, the control unit 100B controls the feeding motor 31 and the twisting motor 80 to execute a series of operations of binding the reinforcing bars S with the wire W, in step SB6.

Thereby, after the output of the first output unit 15 becomes on, even though the output of the first output unit 15 becomes off, the binding operation is executed when the output of the second output unit 12A becomes on, for the predetermined time.

In addition, after executing the binding operation, the control unit 100B returns to step SB2 to determine whether it is detected that the output of the first output unit 15 is on. When it is detected that the output of the first output unit 15 is on, the control unit 100B sets the time measurement value t of the timer 101T to 0, in step SB3, and starts the time measurement by the timer 101T, in step SB4.

Further, after the operation starts, the control unit 100B sets the time measurement value t of the timer 101T to 0 in step SB1 of FIG. 15, and determines in step SB2 whether it is detected that the output of the first output unit 15 is on. When it is detected that the output of the first output unit 15 is off, the control unit 100B determines in step SB7 whether the time measurement value t by the timer 101T is within the predetermined time T.

In this case, since the time measurement value t by the timer 101T is 0, the time measurement value t by the timer 101T is not within the predetermined time T, so that the control unit 100B returns to step SB1. For this reason, when the output of the first output unit 15 is off, even though the output of the second output unit 12A becomes on, the binding operation is not executed.

In this way, in a case where the predetermined time has not elapsed after the output of the first output unit 15 becomes on and the time measurement is thus enabled to start, the control unit 100B executes control of regarding that the output of the first output unit 15 is on, even when the output of the first output unit 15 becomes off. In addition, a circuit configuration where when the output of the first output unit 15 becomes on, the output is kept as an on state for a predetermined time is also possible.

In order to keep the output of the first output unit 15 as an on state, it is always necessary to continuously grip the operation part 304*t* together with the grip part 304R. However, the grasping position on the grip part 304R may deviate during the operation. For this reason, the output of the first output unit 15 becomes unstable, such as the output of the first output unit 15 being temporarily off. If the output of the first output unit 15 is unstable, even when the operator performs the same operation, the binding operation may be executed or may not be executed, which lower the operation efficiency. Therefore, even when the output of the first output unit 15 becomes off, the control of regarding that the output of the first output unit 15 is on is executed under predetermined conditions, in the present embodiment, within the predetermined time after the output of the first output unit 15 becomes on. Therefore, even when the output of the first output unit 15 is unstable and the on and off outputs are thus repeated, the binding operation can be normally performed.

Thereby, even when the output of the first output unit 15 is unstable and the on and off outputs are thus repeated even though the grip part 304R is grasped, the binding operation can be performed when the contact member 9A is pressed against the reinforcing bars S and is thus moved to the actuation position and the output of the second output unit 12A becomes on.

Note that, the contact member 9A is pressed against the reinforcing bars S and is moved to the actuation position and thus the output of the second output unit 12A becomes on, in a state where the output of the first output unit 15 is off after a predetermined time has elapsed since the output of the first output unit 15 becomes on and the time measurement is thus enabled to start, and even when it is detected that the output of the first output unit 15 becomes on after the output of the second output unit 12A becomes on, the control unit 100A does not start the drive of the feeding motor 31 and the twisting motor 80.

Thereby, after the grip part 304R is grasped and the operation part 304*t* is thus actuated and the output of the first output unit 15 becomes on, the control unit 100B does not start the drive of the feeding motor 31 and the twisting motor 80 unless the contact member 9A is pressed against the reinforcing bars S and is thus moved to the actuation position and the output of the second output unit 12A becomes on, in a state where the output of the first output unit 15 becomes on, i.e., the grip part 304R is grasped.

Figure 16:
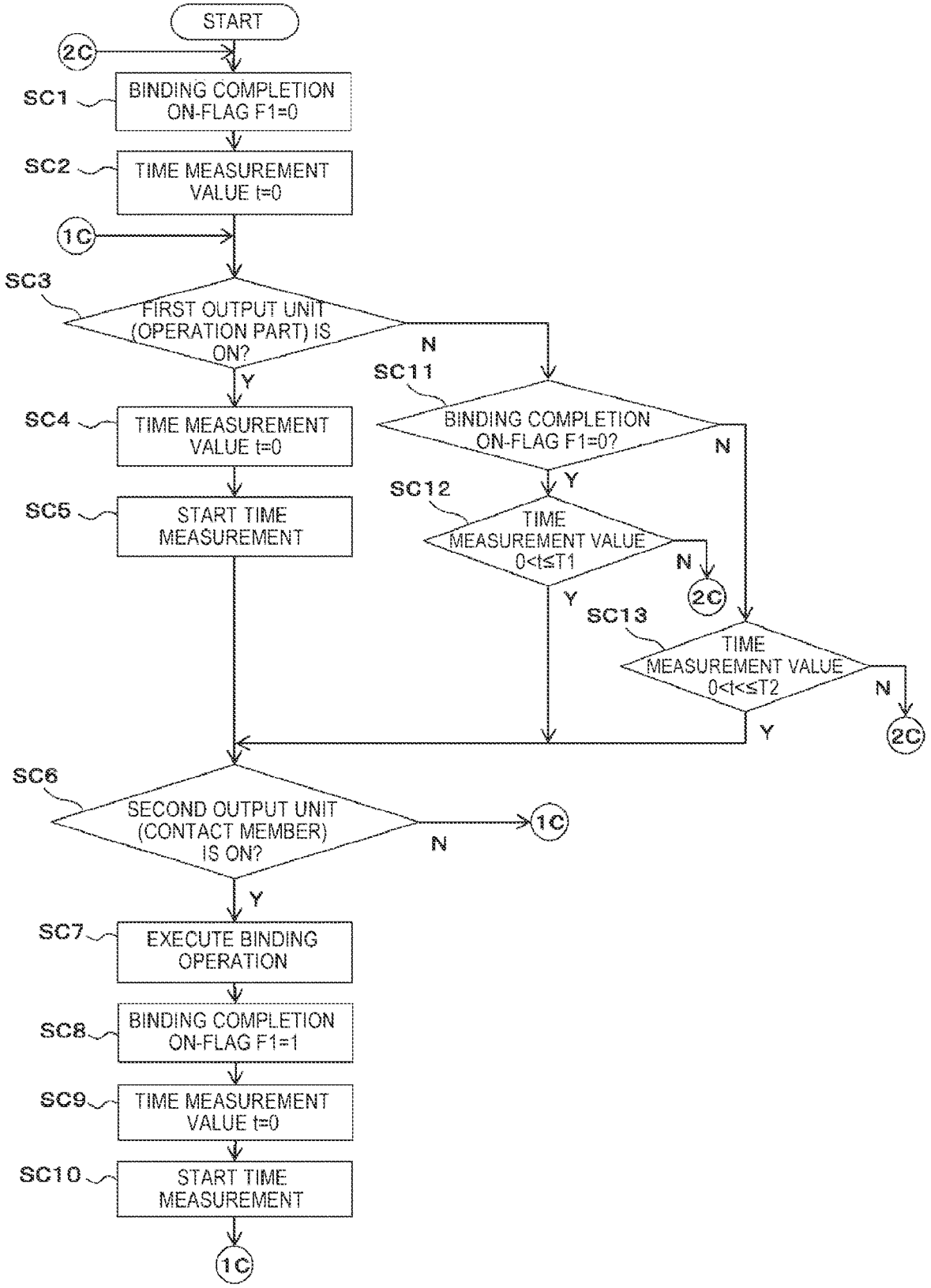
FIG. 16 is a flowchart depicting an example of operations of another modified embodiment of the reinforcing bar binding machine of the first embodiment.

FIG. 16 is a flowchart depicting an example of operations of another modified embodiment of the reinforcing bar binding machine of the first embodiment.

The control unit 100B sets a binding completion on-flag F1, which indicates that the binding operation has been executed, to 0 in step SC1 of FIG. 16, sets the time measurement value t of the timer 101T to 0 in step SC2, and determines whether it is detected that the output of the first output unit 15 is on, in step SC3.

The operator grips the handle part 304*h* of the reinforcing bar binding machine 1A with both hands. That is, the operator grasps the grip part 304R of the handle part 304*h* with a right hand, and grasps the grip part 304L of the handle part 304*h* with a left hand.

When the operation part 304*t* is gripped together with the grip part 304R by the operator, the operation part 304*t* is rotated with respect to the grip part 304R and is thus actuated. When the operation part 304*t* is actuated, the output of the first output unit 15 becomes on and the control unit 100B detects that the output of the first output unit 15 is on, in step SC3 of FIG. 16. When it is determined that it is detected that that the output of the first output unit 15 is on, i.e., it is determined that the first signal is detected, the control unit 100B sets the time measurement value t of the timer 101T to 0 in step SC4, and starts the time measurement by the timer 101T in step SC5.

The operator grips the handle part 304*h* of the reinforcing bar binding machine 1A with both hands, aligns the position of the guide part 5 with the intersection point of the two reinforcing bars S, and inserts the reinforcing bars S into the insertion/pulling-out opening 53. The operator presses the contact parts 91A of the contact member 9A against the reinforcing bars S by the operation of moving the reinforcing bar binding machine 1A in the direction of inserting the reinforcing bars S into the insertion/pulling-out opening 53.

By the operation of moving the reinforcing bar binding machine 1A in the direction of inserting the reinforcing bars S into the insertion/pulling-out opening 53, the contact member 9A is applied with a force along the moving direction of the reinforcing bar binding machine 1A, so that the contact parts 91A are pushed. Thereby, the contact parts 91A are moved in the first direction denoted with the arrow A1, so that the contact member 9A rotates about the shaft 90A as a support point, thereby moving to the actuation position, as shown in FIG. 10B.

When the contact member 9A is moved to the actuation position, the rotation of the connecting part 92A about the shaft 90A as a support point causes the displacing part 93A to push the second guide 52 toward the first guide 51, so that the second guide 52 is moved to the second position.

When it is detected that the output of the first output unit 15 becomes on, i.e., when the first signal is detected, the control unit 100B determines whether it is detected that the output of the second output unit 12A is on, in step SC6. When it is determined in step SC6 that it is detected that the output of the second output unit 12A is off, the control unit 100B returns to step SC3.

When the second guide 52 is moved to the second position, the output of the second output unit 12A becomes on and the control unit 100B detects that the output of the second output unit 12A is on, in step SC6 of FIG. 16.

When it is detected that the output of the second output unit 12A is on, i.e., when the second signal is detected, in step SC6 of FIG. 16, the control unit 100B controls the feeding motor 31 and the twisting motor 80 to execute a series of operations of binding the reinforcing bars S with the wire W, in step SC7.

After executing the binding operation, the control unit 100B sets the binding completion on-flag F1 to 1 in step SC8, sets the time measurement value t of the timer 101T to 0 in step SC9, and starts the time measurement by the timer 101T in step SC10. Then, the control unit 100B returns to step SC3 to determine whether it is detected that the output of the first output unit 15 is on.

As described above, when the operation part 304*t* is actuated and thus the output of the first output unit 15 becomes on, the time measurement by the timer 101T is enabled to start. Thereby, when the output of the first output unit 15 becomes off after the output of the first output unit 15 becomes on, the time measurement by the timer 101T is performed. In addition, when the binding operation is executed, the time measurement by the timer 101T is enabled to start. For example, the grip part 304R is grasped and the operation part 304*t* is thus actuated by the operator, so that the output of the first output unit 15 becomes on. Thereafter, the output of the first output unit 15 may become off because the grasping position on the grip part 304R deviates during the operation, for example. In this case, the output of the first output unit 15 becomes on, so that the time measurement by the timer 101T is performed.

Therefore, when it is determined in step SC3 that it is detected that the output of the first output unit 15 is off, the control unit 100B determines in step SC11 whether the binding completion on-flag F1 is 0 or 1. Then, the control unit 100B determines whether the time measurement value t by the timer 101T is within the predetermined time, depending on whether the binding completion on-flag F1 is 0 or 1.

That is, when it is determined in step SC11 that the binding completion on-flag F1 is 0, the control unit 100B determines in step SC12 whether the time measurement value t by the timer 101T is within the predetermined time T1. A state where the binding completion on-flag F1 is 0 indicates a case where the binding operation is not executed after the output of the first output unit 15 becomes on.

When it is determined in step SC12 that the time measurement value t by the timer 101T is greater than 0 and equal to or less than T1 and is within the predetermined time T1, the control unit 100B determines in step SC6 whether it is detected that the output of the second output unit 12A is on. When it is detected in step SC6 that the output of the second output unit 12A is on, the control unit 100B controls the feeding motor 31 and the twisting motor 80 to execute a series of operations of binding the reinforcing bars S with the wire W, in step SC7.

Thereby, even though the output of the first output unit 15 becomes off after the output of the first output unit 15 becomes on, the binding operation is executed when the output of the second output unit 12A becomes on, for the predetermined time T1.

When it is determined in step SC11 that the binding completion on-flag F1 is 1, the control unit 100B determines in step SC13 whether the time measurement value t by the timer 101T is within a predetermined time T2. A state where the binding completion on-flag F1 is 1 indicates a case where the binding operation is executed after the output of the first output unit 15 becomes on. Here, time T2 is set longer than time T1.

When it is determined in step SC13 that the time measurement value t by the timer 101T is greater than 0 and equal to or less than T2 and is within the predetermined time T2, the control unit 100B determines in step SC6 whether it is detected that the output of the second output unit 12A is on. Then, when it is detected in step SC6 that the output of the second output unit 12A is on, the control unit 100B controls the feeding motor 31 and the twisting motor 80 to execute a series of operations of binding the reinforcing bars S with the wire W, in step SC7.

Thereby, even though the output of the first output unit 15 becomes off after the binding operation is executed, the binding operation is executed when the output of the second output unit 12A becomes on, for the predetermined time T2.

After starting the operation, the control unit 100B sets the binding completion on-flag F1 to 0 in step SC1, sets the time measurement value t of the timer 101T to 0 in step SC2, and determines whether it is detected that the output of the first output unit 15 is on in step SC3. Then, when it is detected that the output of the first output unit 15 is off, since the binding completion on-flag F1 is 0 in step SC11, the control unit 100B determines whether the time measurement value t by the timer 101T is within the predetermined time T1 in step SC12.

In this case, since the time measurement value t by the timer 101T is 0, the time measurement value t by the timer 101T is not within the predetermined time T1, so that the control unit 100B returns to step SC1. For this reason, when the output of the first output unit 15 is off, the binding operation is not executed even though the output of the second output unit 12A becomes on.

In a case where the predetermined time has not elapsed after the time measurement is enabled to start because the output of the first output unit 15 becomes on, even when the output of the first output unit 15 becomes off, the control unit 100B executes control of regarding that the output of the first output unit 15 is on. In addition, a circuit configuration where when the output of the first output unit 15 becomes on, the output is kept as an on state for a predetermined time is also possible.

As described above, if the output of the first output unit 15 is unstable, even when the operator performs the same operation, the binding operation may be executed or may not be executed, which lower the operation efficiency. Therefore, even when the output of the first output unit 15 becomes off, the control of regarding that the output of the first output unit 15 is on is executed under predetermined conditions, in the present embodiment, within the predetermined time after the output of the first output unit 15 becomes on or the binding operation is executed. Therefore, even when the output of the first output unit 15 is unstable and the on and off outputs are thus repeated, the binding operation can be normally performed.

Thereby, even when the output of the first output unit 15 is unstable and the on and off outputs are thus repeated even though the grip part 304R is grasped, the binding operation can be performed when the contact member 9A is pressed against the reinforcing bars S and is thus moved to the actuation position and the output of the second output unit 12A becomes on.

In addition, before and after executing the binding operation, the control unit 100B changes the predetermined time for which the output of the first output unit 15 is regarded as an on state, and sets the predetermined time, for which the output of the first output unit 15 is regarded as an on state, longer after the binding operation is executed than before the binding operation is executed.

Before the binding operation is executed, the grasping on the grip part 304R may be unstable due to deviation of a position of a hand grasping the grip part 304R. In this state, the predetermined time T1 is set so that the binding operation is not executed even when the contact member 9A is pressed against the reinforcing bars S and is thus moved to the actuation position and the output of the second output unit 12A becomes on.

In contrast, after the binding operation is executed, it is considered to perform an operation of moving the reinforcing bar binding machine 1A so as to continuously perform binding of next reinforcing bars S. In this case, in a state where a position of a hand grasping the grip part 304R deviates and thus the output of the first output unit 15 is temporarily off, if the time for which the output of the first output unit 15 is regarded as an on state is short, there is no grace period for moving the reinforcing bar binding machine 1A to next reinforcing bars S. Therefore, the predetermined time T2 for which the output of the first output unit 15 is regarded as an on state is set longer than time T1.

Then, when the binding operation is executed, the time measurement value is cleared and the time measurement operation is again performed. When the predetermined time has not elapsed, the control of regarding that the output of the first output unit 15 is on is executed even though the output of the first output unit 15 becomes off.

Therefore, when continuously performing the binding operation, even though the force of grasping the grip part 304R is temporarily weakened, so that the operation part 304*t* is not actuated and the output of the first output unit 15 becomes temporarily off, the time for which the output of the first output unit 15 is regarded as an on state is prolonged, so that the continuous binding operation can be performed.

Figure 17:
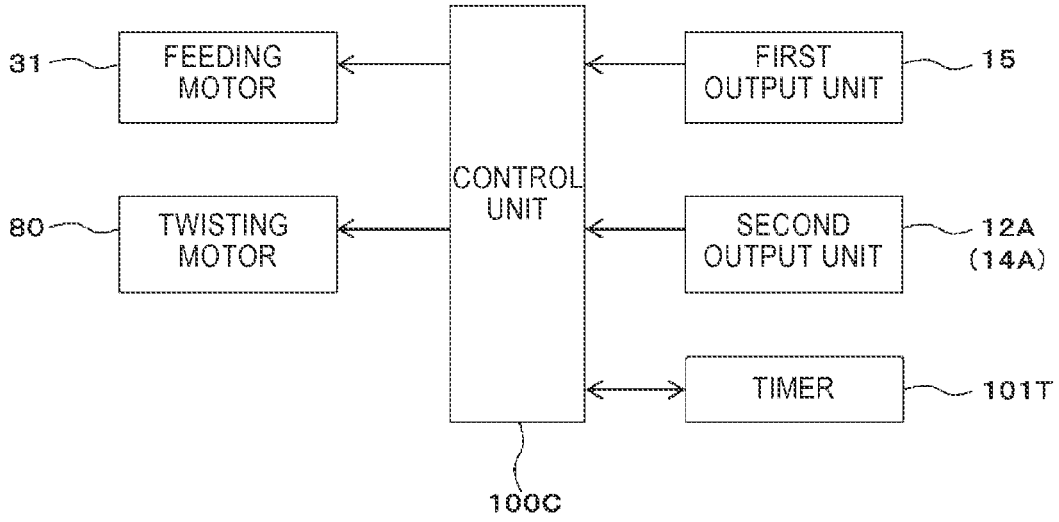
FIG. 17 is a functional block diagram of still another modified embodiment of the reinforcing bar binding machine of the first embodiment.

FIG. 17 is a functional block diagram of still another modified embodiment of the reinforcing bar binding machine of the first embodiment. A control unit 100C switches a first output unit on-flag F2, which indicates that the output of the first output unit 15 becomes on or off. The control unit 100C performs the time measurement by the timer 101T, based on whether the output of the first output unit 15 becomes off and the first output unit on-flag F2, and performs control of regarding that the output of the first output unit 15 is on, for a predetermined time, even when the output of the first output unit 15 becomes off.

Figure 18:
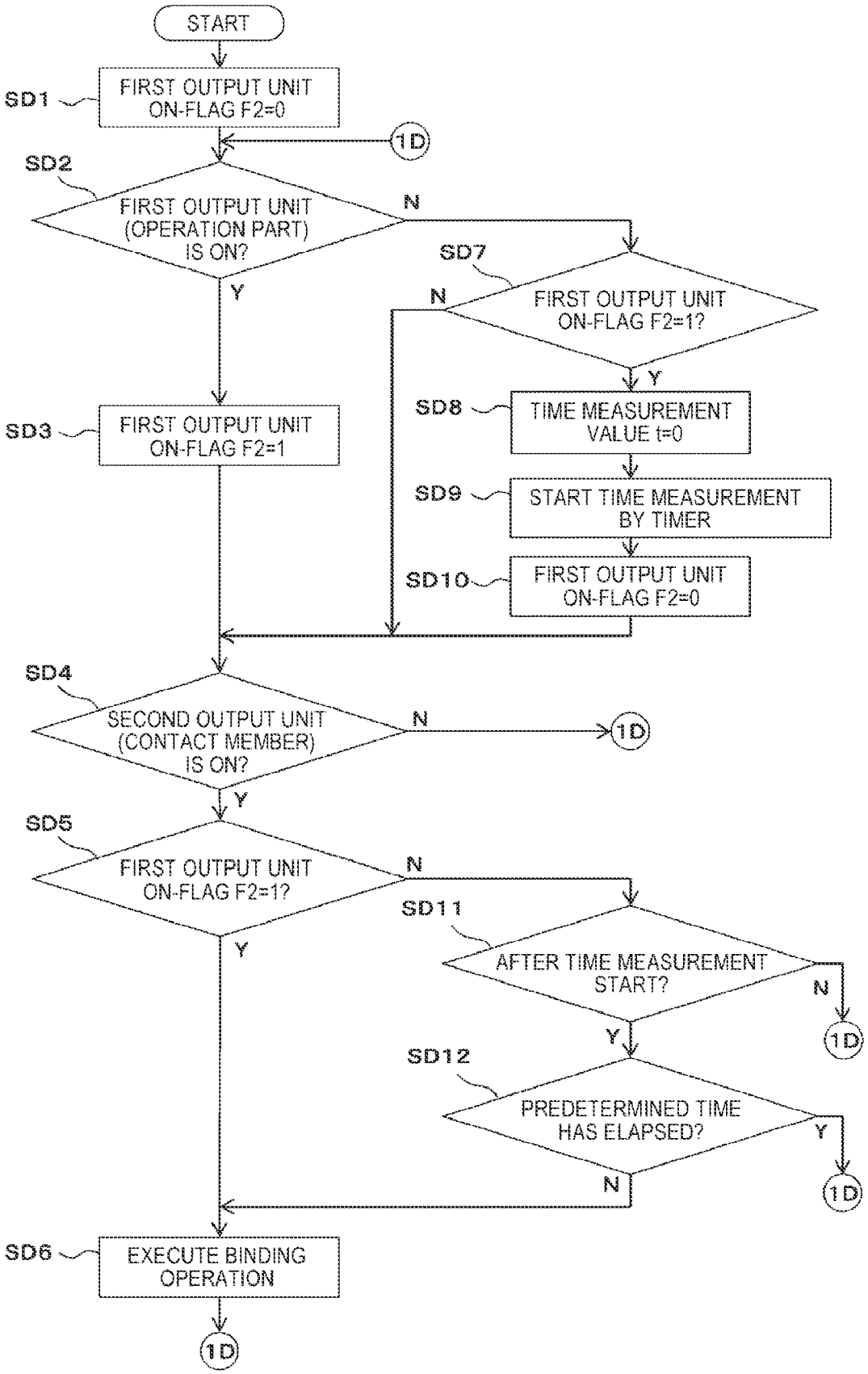
FIG. 18 is a flowchart depicting an example of operations of still another modified embodiment of the reinforcing bar binding machine of the first embodiment.

FIG. 18 is a flowchart depicting an example of operations of still another modified embodiment of the reinforcing bar binding machine of the first embodiment.

Figure 19:
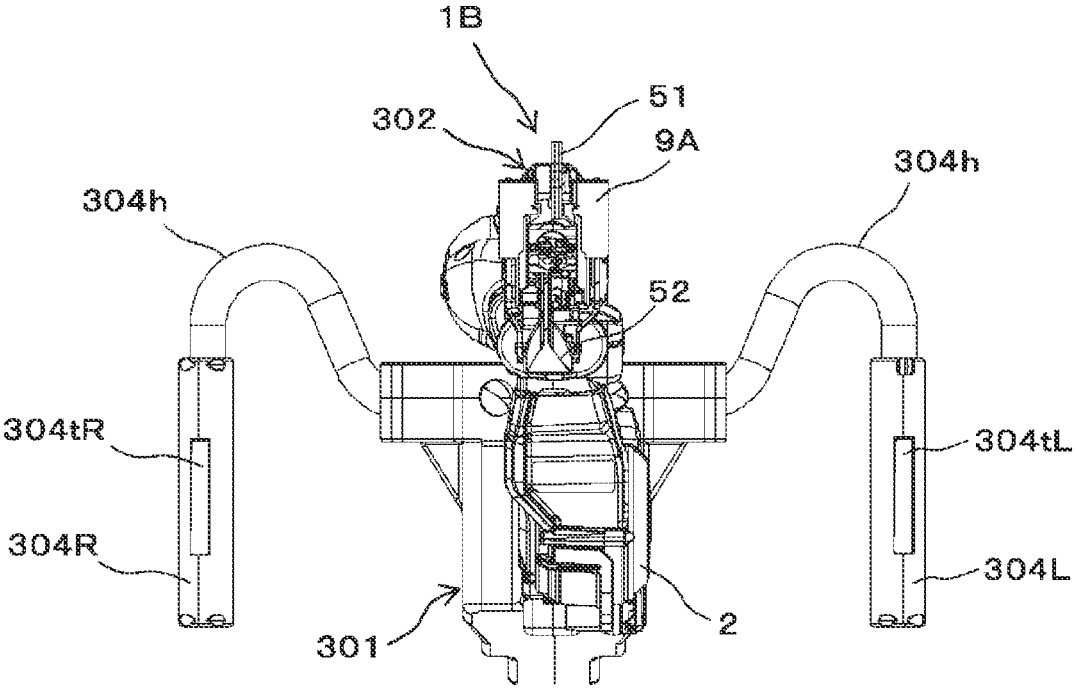
FIG. 19 is a front view depicting an example of an overall configuration of a reinforcing bar binding machine of a second embodiment.

In step SD1 of FIG. 19, the control unit 100C sets the first output unit on-flag F2 to 0.

The operator grips the handle part 304*h* of the reinforcing bar binding machine 1A with both hands. That is, the operator grasps the grip part 304R of the handle part 304*h* with a right hand, and grasps the grip part 304L of the handle part 304*h* with a left hand.

When the operation part 304*t* is gripped together with the grip part 304R by the operator, the operation part 304*t* is rotated with respect to the grip part 304R and is thus actuated. When the operation part 304*t* is actuated, the output of the first output unit 15 becomes on and the control unit 100C detects that the output of the first output unit 15 is on, in step SD2 of FIG. 16. When it is detected that that the output of the first output unit 15 is on, the control unit 100C sets the first output unit on-flag F2 to 1 in step SD3.

The operator grips the handle part 304*h* of the reinforcing bar binding machine 1A with both hands, aligns the position of the guide part 5 with the intersection point of the two reinforcing bars S, and inserts the reinforcing bars S into the insertion/pulling-out opening 53. The operator presses the contact parts 91A of the contact member 9A against the reinforcing bars S by the operation of moving the reinforcing bar binding machine 1A in the direction of inserting the reinforcing bars S into the insertion/pulling-out opening 53.

By the operation of moving the reinforcing bar binding machine 1A in the direction of inserting the reinforcing bars S into the insertion/pulling-out opening 53, the contact member 9A is applied with a force along the moving direction of the reinforcing bar binding machine 1A, so that the contact parts 91A are pushed. Thereby, the contact parts 91A are moved in the first direction denoted with the arrow A1, so that the contact member 9A rotates about the shaft 90A as a support point, thereby moving to the actuation position, as shown in FIG. 10B.

When the contact member 9A is moved to the actuation position, the rotation of the connecting part 92A about the shaft 90A as a support point causes the displacing part 93A to push the second guide 52 toward the first guide 51, so that the second guide 52 is moved to the second position.

When the second guide 52 is moved to the second position, the output of the second output unit 12A becomes on and the control unit 100C detects that the output of the second output unit 12A is on, in step SD4 of FIG. 18.

When it is detected that the output of the second output unit 12A is on, the control unit 100C determines whether the first output unit on-flag F2 is 1 or 0, in step SD5 of FIG. 18.

When it is determined that the first output unit on-flag F2 is 1, the control unit 100C controls the feeding motor 31 and the twisting motor 80 to execute a series of operations of binding the reinforcing bars S with the wire W, in step SD6 of FIG. 18.

When it is detected in step SD2 that the output of the first output unit 15 becomes off, the control unit 100C determines in step SD7 whether the first output unit on-flag F2 is 1 or 0.

When it is determined that the first output unit on-flag F2 is 1, the control unit 100C sets the time measurement value t of the timer 101T to 0 in step SD8 and starts the time measurement by the timer 101T in step SD9. In addition, the control unit 100C sets the first output unit on-flag F2 to 0 in step SD10, and monitors whether the output of the second output unit 12A becomes on in step SD4.

When it is detected that the output of the second output unit 12A becomes on, the control unit 100C determines whether the first output unit on-flag F2 is 1 or 0, in step SD5 of FIG. 18.

When it is determined that the first output unit on-flag F2 is 0, the control unit 100C determine in step SD11 of FIG. 18 whether it is after time measurement start.

When it is determined that it is after time measurement start, the control unit 100C determines in step SD12 of FIG. 18 whether the predetermined time has elapsed after the output of the first output unit 15 becomes off and thus the time measurement by the timer 101T is enabled to start.

When it is determined that the predetermined time has not elapsed after the output of the first output unit 15 becomes off and thus the time measurement by the timer 101T is enabled to start, the control unit 100C controls the feeding motor 31 and the twisting motor 80 to execute a series of operations of binding the reinforcing bars S with the wire W in step SD6.

When it is determined that the predetermined time has elapsed after the output of the first output unit 15 becomes off and thus the time measurement by the timer 101T is enabled to start, the control unit 100C returns to step SD2 without executing the binding operation.

In order to keep the output of the first output unit 15 as an on state, it is always necessary to continuously grip the operation part 304*t* together with the grip part 304R. However, the grasping position on the grip part 304R may deviate during the operation. For this reason, the output of the first output unit 15 becomes unstable, such as the output of the first output unit 15 being temporarily off. If the output of the first output unit 15 is unstable, even when the operator performs the same operation, the binding operation may be executed or may not be executed, which lower the operation efficiency. Therefore, even when the output of the first output unit 15 becomes off, the control of regarding that the output of the first output unit 15 is on is executed for the predetermined time.

The predetermined time for which the binding operation can be executed since the output of the first output unit 15 becomes off is set longer than a time for which the output of the first output unit 15 becomes unstable and the output becomes temporarily off. Thereby, a case where after the output of the first output unit 15 becomes on, even though the grip part 304R is grasped, the output of the first output unit 15 is unstable and the output becomes off, and a case where the grasped state of the grip part 304R is intentionally released by the operator and thus the output of the first output unit 15 becomes off can be identified.

Example of Reinforcing Bar Binding Machine of Second Embodiment

FIG. 19 is a front view depicting an example of an overall configuration of a reinforcing bar binding machine of a first embodiment. A reinforcing bar binding machine 1B of the second embodiment includes a handle part 304*h* having a pair of grip parts 304L and 304R that can be grasped by an operator.

The handle part 304*h* has an operation part 304*t*R provided to the grip part 304R that is mainly grasped with a right hand. The operation part 304*t*R is attached to the grip part 304R so as to be rotatable about a shaft (not shown) as a support point, for example, and protrudes from a surface of the grip part 304R. The operation part 304*t*R is gripped together with the grip part 304R by the operator, so that it is rotated with respect to the grip part 304R and is thus actuated.

The handle part 304*h* also has an operation part 304*t*L provided to the grip part 304L that is mainly grasped with a left hand. The operation part 304*t*L is attached to the grip part 304L so as to be rotatable about a shaft (not shown) as a support point, for example, and protrudes from a surface of the grip part 304L. The operation part 304*t*L is gripped together with the grip part 304L by the operator, so that it is rotated with respect to the grip part 304L and is thus actuated. Note that, the other configurations of the reinforcing bar binding machine 1B are the same as the reinforcing bar binding machine 1A of the first embodiment 1A.

Figure 20:
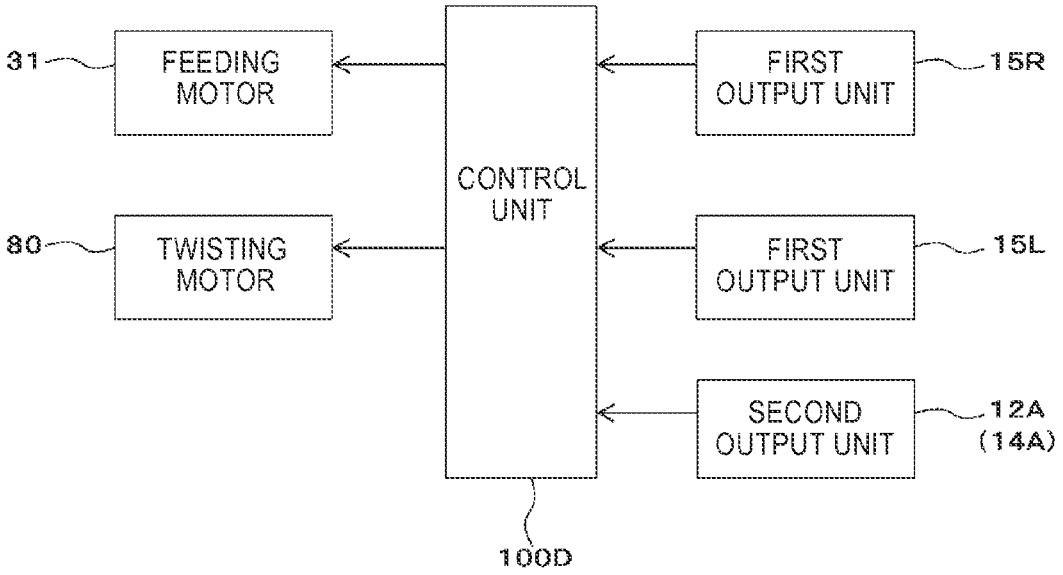
FIG. 20 is a functional block diagram of the reinforcing bar binding machine of the second embodiment.

FIG. 20 is a functional block diagram of the reinforcing bar binding machine of the second embodiment. In the reinforcing bar binding machine 1B, a control unit 100D is configured to detect outputs of a first output unit 15R configured to be actuated by an operation on the operation part 304*t*R, a first output unit 15L configured to be actuated by an operation on the operation part 304*t*L, and a second output unit 12A configured to be actuated as the contact member 9A is pressed against the reinforcing bars S. The control unit 100D is configured to control the feeding motor 31 configured to drive the feeding gears 30 and the twisting motor 80 configured to drive the twisting unit 7 and the like, in response to the outputs of the first output unit 15R, the first output unit 15L and the second output unit 12A, thereby executing a series of operations of binding the reinforcing bars S with the wire W.

Subsequently, operations of binding the reinforcing bars S with the wire W by the reinforcing bar binding machine 1B are described. The operator grips the handle part 304*h* of the reinforcing bar binding machine 1B with both hands. That is, the operator grasps the grip part 304R of the handle part 304*h* with a right hand and grasps the grip part 304L of the handle part 304*h* with a left hand.

When the operation part 304*t*R is grasped together with the grip part 304R by the operator, the operation part 304*t*R rotates with respect to the grip part 304R and is thus actuated. When the operation part 304*t*R is actuated, the output of the first output unit 15R becomes on, and the control unit 100D detects that the output of the first output unit 15R becomes on. Also, when the operation part 304*t*L is grasped together with the grip part 304L by the operator, the operation part 304*t*L rotates with respect to the grip part 304L and is thus actuated. When the operation part 304*t*L is actuated, the output of the first output unit 15L becomes on, and the control unit 100D detects that the output of the first output unit 15L becomes on.

The operator grips the handle part 304*h* of the reinforcing bar binding machine 1B with both hands, aligns a position of the guide part 5 with an intersection point of the two reinforcing bars S, and inserts the reinforcing bars S into the insertion/pulling-out opening 53. The operator presses the contact parts 91A of the contact member 9A against the reinforcing bars S by an operation of moving the reinforcing bar binding machine 1B in a direction of inserting the reinforcing bars S into the insertion/pulling-out opening 53.

By the operation of moving the reinforcing bar binding machine 1B in the direction of inserting the reinforcing bars S into the insertion/pulling-out opening 53, the contact member 9A is applied with a force along the moving direction of the reinforcing bar binding machine 1B, so that the contact parts 91A are pushed. Thereby, the contact parts 91A are moved in the first direction denoted with the arrow A1, so that the contact member 9A rotates about the shaft 90A as a support point, thereby moving to the actuation position, as shown in FIG. 10B.

When the contact member 9A is moved to the actuation position, the rotation of the connecting part 92A about the shaft 90A as a support point causes the displacing part 93A to push the second guide 52 toward the first guide 51, so that the second guide 52 is moved to the second position.

When the second guide 52 is moved to the second position, the output of the second output unit 12A becomes on, and the control unit 100D detects that the output of the second output unit 12A becomes on.

In a state where it is detected that the outputs of both the first output unit 15R and the first output unit 15L become on, when it is detected that the output of the second output unit 12A becomes on, the control unit 100D controls the feeding motor 31 and the twisting motor 80 to execute a series of operations of binding the reinforcing bars S with the wire W.

Note that, in a state where the outputs of both the first output unit 15R and the first output unit 15L are not on and an output of any one of the first output units is on, even when it is detected that the output of the second output unit 12A becomes on, the control unit 100D does not start the drive of the feeding motor 31 and the twisting motor 80.

On the other hand, in a state where after the outputs of both the first output unit 15R and the first output unit 15L become on, an output of any one of the first output units becomes off and the outputs of both the first output units again become on, when it is detected that the output of the second output unit 12A becomes on, the control unit 100D starts the drive of the feeding motor 31 and the twisting motor 80.

Thereby, after both the grip parts 304R and 304L are securely held, even though the force of grasping one of the grip parts is temporarily weakened and the output of any one of the first output units becomes temporarily off, the binding operation can be performed after both the grip parts 304R and 304L are securely held. Note that, in a state where both the first output unit 15R and the first output unit 15L are not on and an output of any one of the first output units becomes on, when it is detected that the output of the second output unit 12A becomes on, the control unit 100D may start the drive of the feeding motor 31 and the twisting motor 80.

Example of Reinforcing Bar Binding Machine of Third Embodiment

Figure 21A:
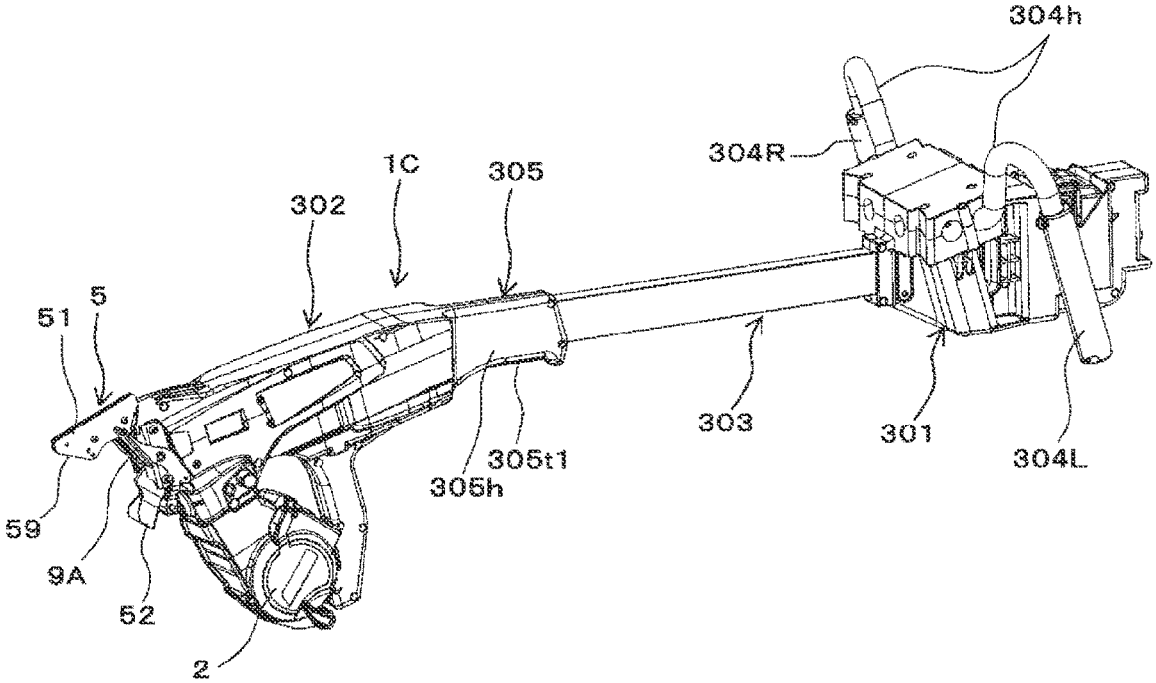
FIG. 21A is a perspective view depicting an example of an overall configuration of a reinforcing bar binding machine of a third embodiment.
Figure 21B:
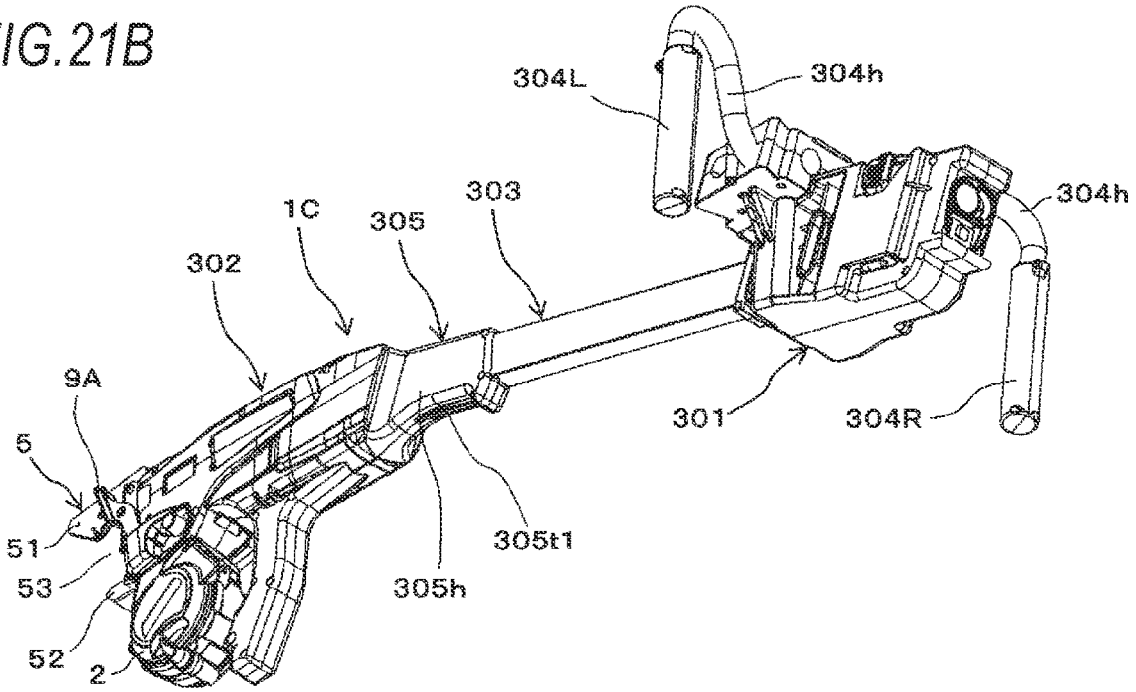
FIG. 21B is a perspective view depicting the example of the overall configuration of the reinforcing bar binding machine of the third embodiment.
Figure 22:
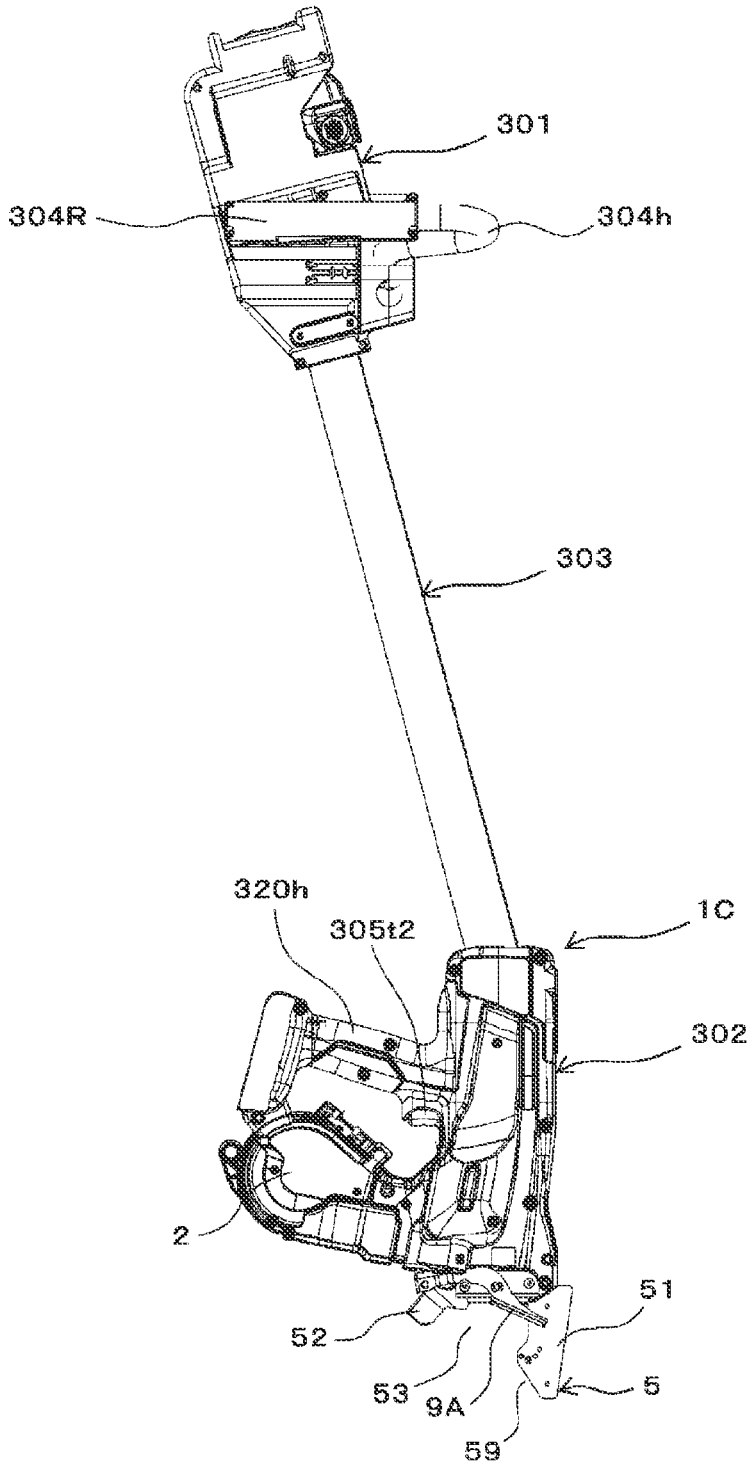
FIG. 22 is a side view depicting another example of the overall configuration of the reinforcing bar binding machine of the third embodiment.

FIGS. 21A and 21B are perspective views depicting an example of an overall configuration of a reinforcing bar binding machine of a third embodiment, and FIG. 22 is a side view depicting another example of the overall configuration of the reinforcing bar binding machine of the third embodiment.

A reinforcing bar binding machine 1C of the third embodiment includes a sub-operation part provided to the second body part 302 or to a joining part 305 of the second body part 302 and the connecting part 303. In FIGS. 21A and 21B, a sub-operation part 305*t*1 is provided to a grip part 305*h* provided to the joining part 305.

The sub-operation part 305*t*1 is an example of the first sub-operation part, is attached to the joining part 305 so as to be rotatable about a shaft (not shown) as a support point, and protrudes from a surface of the grip part 305*h*. The sub-operation part 305*t*1 is gripped together with the grip part 305*h* by the operator, so that it is rotated with respect to the grip part 305*h* and is thus actuated.

In FIG. 22, a sub-operation part 305*t*2 is provided to a handle part 320*h* provided to the second body part 302. The sub-operation part 305*t*2 is an example of the second sub-operation part, and is configured to be actuated by a pulling operation with a finger of a hand grasping the handle part 320*h*. Note that, the other configurations of the reinforcing bar binding machine 1C are the same as the reinforcing bar binding machine 1A of the first embodiment.

Figure 23:
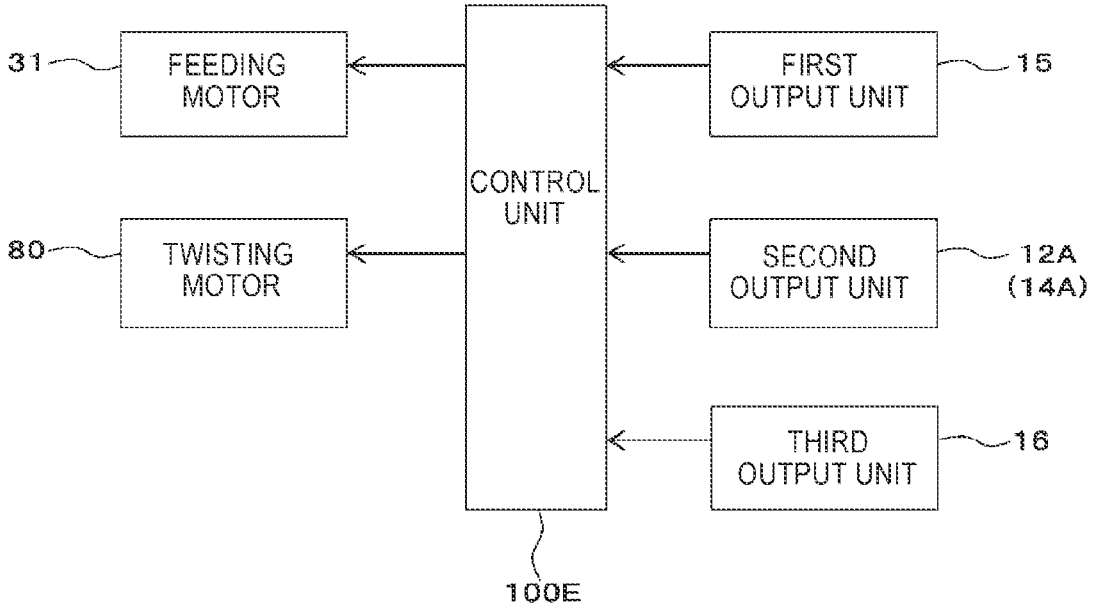
FIG. 23 is a functional block diagram of the reinforcing bar binding machine of the third embodiment.

FIG. 23 is a functional block diagram of the reinforcing bar binding machine of the third embodiment. In the reinforcing bar binding machine 1C, a control unit 100E is configured to detect outputs of a first output unit 15 configured to be actuated by an operation on the operation part 304*t*, a second output unit 12A configured to be actuated as the contact member 9A is pressed against the reinforcing bars S, and a third output unit 16 configured to be actuated by an operation on the sub-operation part 305*t*1 shown in FIGS. 21A and 21B or an operation on the sub-operation part 305*t*2 shown in FIG. 22. The control unit 100E is configured to control the feeding motor 31 configured to drive the feeding gears 30 and the twisting motor 80 configured to drive the twisting unit 7 and the like, in response to the outputs of the first output unit 15, the second output unit 12A, and the third output unit 16, thereby executing a series of operations of binding the reinforcing bars S with the wire W.

Subsequently, operations of the reinforcing bar binding machine 1C of the third embodiment are described. Note that, the binding operation that is performed with gripping the handle part 304*h* with both hands is similar to the example described with reference to FIGS. 13, 15 and 16 and the like.

In order to bind the reinforcing bars S at the feet of the operator, it is presumed that the reinforcing bar binding machine 1C is used with the guide part 5 facing downward in a state where the operator stands with gripping the handle part 304*h* with both hands. For this reason, the grip part 304R of the handle part 304*h* is provided with the operation part 304*t*.

Note that, in a case where the reinforcing bars S that are a binding object are spaced with a gap without contacting each other at an intersection point, i.e., in a case where an upper surface of one reinforcing bar S is not contacted to a lower surface of the other reinforcing bar S, the operator may perform the binding operation while lifting (correcting a position) one or the other reinforcing bar S so that the intersecting reinforcing bars S are contacted to each other. In this case, since the operator is in a posture of bending the knees and crouching, it is difficult to grasp the grip part of the handle part 304*h* provided to the first body part 301 connected to the second body part 302 by the connecting part 303.

Therefore, the reinforcing bar binding machine 1C has the sub-operation part 305*t*1 provided to the joining part 305 of the second body part 302 and the connecting part 303. Alternatively, the second body part 302 is provided with the sub-operation part 305*t*2.

In a case where the reinforcing bar binding machine 1C has a shape as shown in FIGS. 21A and 21B, the operator grasps the grip part 305*h* provided to the joining part 305 of the second body part 302 and the connecting part 303. In addition, in a case where the reinforcing bar binding machine 1C has a shape as shown in FIG. 22, the operator grasps the handle part 320*h* provided to the second body part 302.

Thereby, in the case shown in FIGS. 21A and 21B, the sub-operation part 305*t*1 is actuated, and in the case shown in FIG. 22, the sub-operation part 305*t*2 is actuated and thus the output of the third output unit 16 becomes on, and the control unit 100E detects that the output of the third output unit 16 becomes on.

The operator aligns the position of the guide part 5 with the intersection point of the two reinforcing bars S, and inserts the reinforcing bars S into the insertion/pulling-out opening 53. The operator presses the contact parts 91A of the contact member 9A against the reinforcing bars S by an operation of moving the reinforcing bar binding machine 1C in the direction of inserting the reinforcing bars S into the insertion/pulling-out opening 53.

By the operation of moving the reinforcing bar binding machine 1C in the direction of inserting the reinforcing bars S into the insertion/pulling-out opening 53, the contact member 9A is applied with a force along the moving direction of the reinforcing bar binding machine 1C, so that the contact parts 91A are pushed. Thereby, the contact parts 91A are moved in the first direction denoted with the arrow A1, so that the contact member 9A rotates about the shaft 90A as a support point, thereby moving to the actuation position, as shown in FIG. 10B.

When the contact member 9A is moved to the actuation position, the rotation of the connecting part 92A about the shaft 90A as a support point causes the displacing part 93A to push the second guide 52 toward the first guide 51, so that the second guide 52 is moved to the second position.

When the second guide 52 is moved to the second position, the output of the second output unit 12A becomes on, and the control unit 100E detects that the output of the second output unit 12A is on.

When it is detected that the output of the second output unit 12A becomes on, in a state where it is detected that the output of the third output unit 16 becomes on, the control unit 100E controls the feeding motor 31 and the twisting motor 80 to execute a series of operations of binding the reinforcing bars S with the wire W.

Thereby, it is possible to perform the binding operation even in a posture where it is not possible to grasp the grip part of the handle part 304*h* provided to the first body part 301.

Example of Reinforcing Bar Binding Machine of Fourth Embodiment

Figure 24:
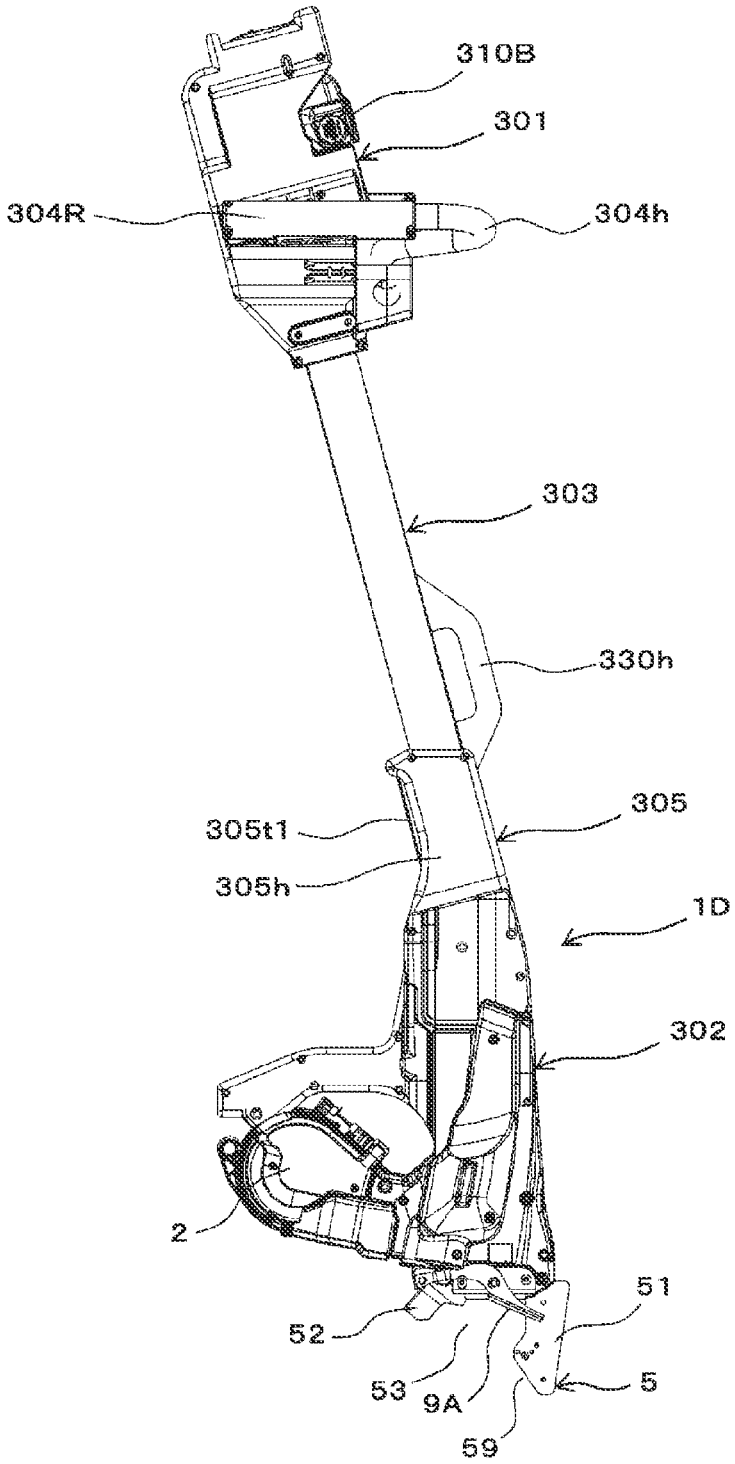
FIG. 24 is a side view depicting an example of an overall configuration of a reinforcing bar binding machine of a fourth embodiment.

FIG. 24 is a side view depicting an example of an overall configuration of a reinforcing bar binding machine of a fourth embodiment. A reinforcing bar binding machine 1D of the fourth embodiment has a handle part 330*h* for carry provided to the connecting part 303 configured to connect the first body part 301 and the second body part 302. The other configurations are similar to the reinforcing bar binding machine 1C described with reference to FIGS. 21A and 21B, for example.

In the reinforcing bar binding machine of each embodiment, the first body part 301 and the second body part 302 are connected by the elongated connecting part 303. The first body part 301 is heavy because the battery 310B is mounted thereto. On the other hand, the second body part 302 is also heavy because the motor configured to drive the feeding unit, the motor configured to drive the twisting unit, the wire reel, and the like are accommodated therein. Therefore, the connecting part 303 configured to connect the first body part 301 and the second body part 302 is provided with the handle part 330*h* for carry, so that it is possible to carry the reinforcing bar binding machine 1D in a substantially horizontal state with balancing the first body part 301-side and the second body part 302-side.

Example of Reinforcing Bar Binding Machine of Fifth Embodiment

Figure 25A:
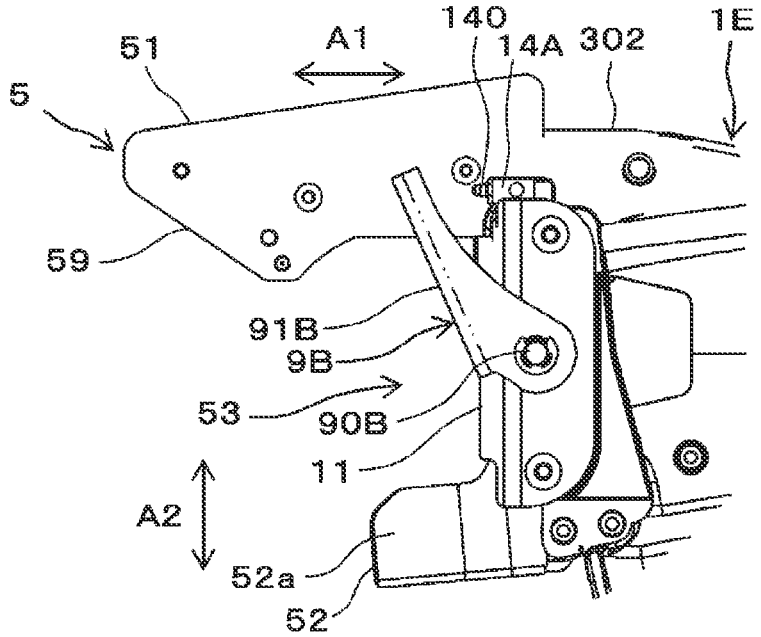
FIG. 25A is a side view depicting main parts of a reinforcing bar binding machine of a fifth embodiment.
Figure 25B:
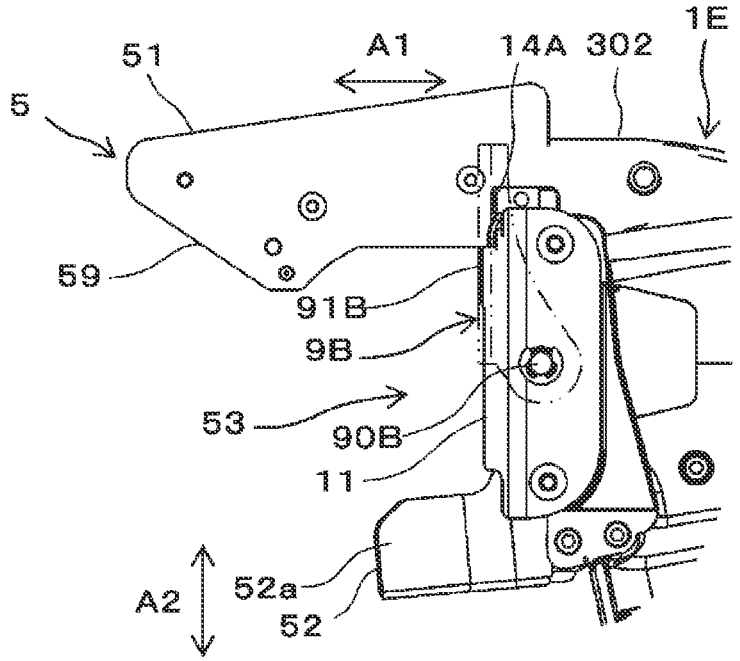
FIG. 25B is a side view depicting the main parts of the reinforcing bar binding machine of the fifth embodiment.

FIGS. 25A and 25B are side views depicting main parts of a reinforcing bar binding machine of a fifth embodiment.

As described with reference to FIG. 1 and the like, a reinforcing bar binding machine 1E is applied to the reinforcing bar binding machine where the first body part 301 and the second body part 302 are connected by the elongated connecting part 303. The reinforcing bar binding machine 1E includes the guide part 5 configured to guide a wire. The guide part 5 has the first guide 51 and the second guide 52. The first guide 51 and the second guide 52 are attached to the end portion on the front side of the second body part 302, and extend in the first direction denoted with the arrow A1. The second guide 52 is provided facing the first guide 51 in the second direction denoted with the arrow A2 orthogonal to the first direction. The second guide 52 may also be configured to be movable toward and away from the first guide 51 by rotation about a shaft (not shown) as a support point. The guide part 5 has the induction part 59 configured to guide the reinforcing bars to the insertion/pulling-out opening 53. The induction part 59 is provided on the tip end-side of the first guide 51.

The reinforcing bar binding machine 1E includes a contact member 9B to which the reinforcing bars S inserted in the insertion/pulling-out opening 53 between the first guide 51 and the second guide 52 are contacted. The contact member 9B is rotatably supported by a shaft 90B and is attached to the second body part 302 via the cover part 11. The contact member 9B has contact parts 91B, which are contacted to the reinforcing bars S, on one side with respect to the shaft 90B. The contact parts 91B of the contact member 9B extend from the shaft 90B toward the first guide 51 in the second direction denoted with the arrow A2.

The contact member 9B has the shaft 90B provided adjacent to a center between the first guide 51 and the second guide 52. The contact member 9B also has a pair of contact parts 91B provided between the first guide 51 and the second guide 52 from the vicinity of a part supported by the shaft 90B toward the first guide 51-side. The contact parts 91B are provided with an interval, through which the wire W binding the reinforcing bars S can pass, on both sides in the third direction. The contact parts 91B extend to both left and right sides of the first guide 51.

The contact member 9B is configured to rotate about the shaft 90B as a support point, thereby moving between a standby position (FIG. 25A) at which the contact parts 91B protrude from the cover part 11 into the insertion/pulling-out opening 53 and an actuation position (FIG. 25B) at which the contact parts 91B come close to the cover part 11. The contact member 9B is urged in a moving direction to the standby position by an urging member (not shown), and is held at the standby position.

When the two intersecting reinforcing bars S are inserted into the insertion/pulling-out opening 53, one reinforcing bar S is located at one side part of the first guide 51 and the other reinforcing bar S is located at the other side part of the first guide 51. In contrast, the pair of contact parts 91B of the contact member 9B extends from between the first guide 51 and the second guide 52 toward both left and right sides of the first guide 51. Thereby, the reinforcing bars S inserted in the insertion/pulling-out opening 53 are securely contacted to the contact parts 91B, so that the contact member 9B can be moved to the actuation position. In addition, the contact parts 91B of the contact member 9B are moved in the first direction denoted with the arrow A1 by the rotating operation about the shaft 90B as a support point. Thereby, the contact parts 91B can be pushed by the operation of moving the reinforcing bar binding machine 1E in the direction of inserting the reinforcing bars S into the insertion/pulling-out opening 53, and it is not necessary to move the reinforcing bar binding machine 1E in another direction so as to actuate the contact member 9B.

The reinforcing bar binding machine 1E includes a second output unit 14A configured to detect that the contact member 9B is moved to the actuation position. As shown in FIG. 25A, when the contact member 9B is moved to the standby position, the contact parts 91B of the contact member 9B are moved away from a movable element 140. In this way, in a state where the contact member 9B is moved to the standby position, an output of the second output unit 14A is set to an off state. In contrast, when the contact parts 91B are pressed against the reinforcing bars and the contact member 9B is thus moved to the actuation position, the contact parts 91B of the contact member 9B are moved in a direction of pushing the movable element 140. In this way, in a state where the contact member 9B is moved to the actuation position, an output of the second output unit 14A is set to an on state.

When it is detected that the output of the second output unit 14A becomes on as the contact member 9B is moved to the actuation position, in a state where the operation part 304*t* is operated and thus the output of the first output unit 15 is on, the control unit 100A shown in FIG. 12 controls the feeding motor 31 and the twisting motor 80 to execute a series of operations of binding the reinforcing bars S with the wire W, as described above.

In addition, when it is detected that the output of the first output unit 15 is on as the operation part 304*t* is operated, the control unit 100B shown in FIG. 14 starts the time measurement by the timer 101T, and when it is detected that the output of the second output unit 14A becomes on, the control unit 100B controls the feeding motor 31 and the twisting motor 80 to execute a series of operations of binding the reinforcing bars S with the wire W, for the predetermined time, as described above. Alternatively, when the binding operation is executed, the control unit 100B clears the time measurement value and starts the time measurement by the timer 101T, and when it is detected that the output of the second output unit 14A becomes on, the control unit 100B executes the binding operation for the predetermined time after the binding operation is executed. In addition, when it is detected that the output of the first output unit 15 is off after it is detected that the output of the first output unit 15 is on as the operation part 304*t* is operated, the control unit 100C shown in FIG. 17 starts the time measurement by the timer 101T. For the predetermined time after it is detected that the output of the first output unit 15 is off, the control unit 100C executes the binding operation when it is detected that the output of the second output unit 14A becomes on. Note that, the control by the control unit 100D shown in FIG. 20 and the control by the control unit 100E shown in FIG. 23 are also similar.

Example of Reinforcing Bar Binding Machine of Sixth Embodiment

Figure 26:
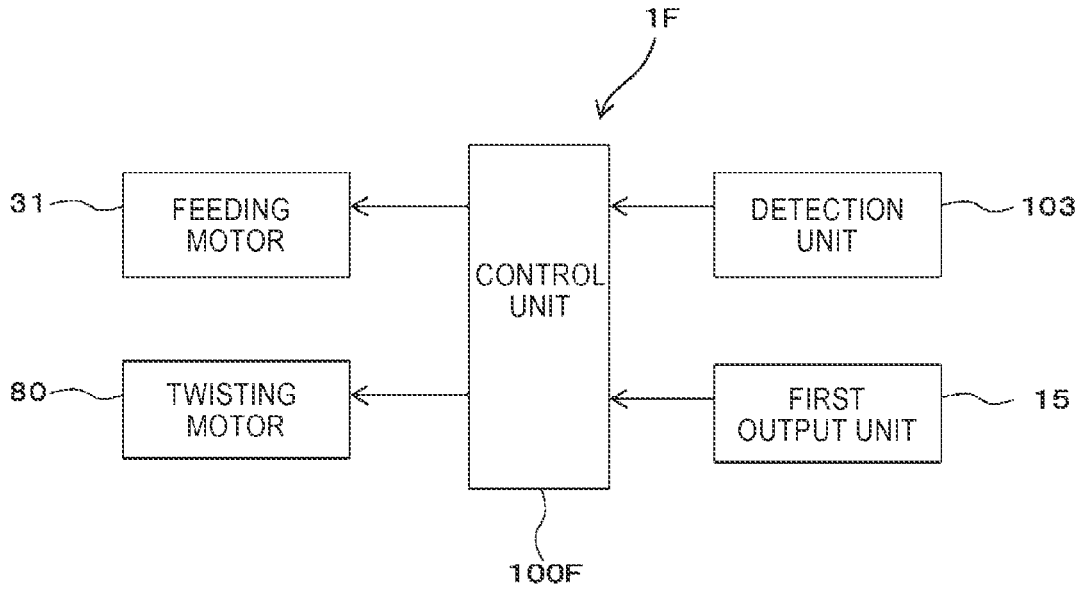
FIG. 26 is a functional block diagram of a reinforcing bar binding machine of a sixth embodiment.

FIG. 26 is a functional block diagram of a reinforcing bar binding machine of a sixth embodiment. A reinforcing bar binding machine 1F includes a detection unit 103 configured to detect the reinforcing bars S. The detection unit 103 is constituted by a contact sensor such as a piezoelectric element, a non-contact sensor such as an image sensor, or the like, and is configured to detect that the reinforcing bars S are inserted in the insertion/pulling-out opening 53 between the first guide 51 and the second guide 52 shown in FIG. 1 and the like.

In a state where it is detected that the output of the first output unit 15 is on as the operation part 304*t* is operated, when it is detected that the output of the detection unit 103 becomes on as the reinforcing bars S are inserted in the insertion/pulling-out opening 53, a control unit 100F executes the binding operation. Alternatively, when it is detected that the output of the first output unit 15 is on as the operation part 304*t* is operated, the control unit 100F starts time measurement by a timer (not shown), and for the predetermined time, when it is detected that the output of the detection unit 103 becomes on, the control unit 100F executes the binding operation. Alternatively, when the binding operation is executed, the control unit 100F clears the time measurement value and starts the time measurement by the timer, and for the predetermined time since the binding operation is executed, when it is detected that the output of the detection unit 103 becomes on, the detection unit 100F executes the binding operation. In addition, after it is detected that the output of the first output unit 15 is on as the operation part 304*t* is operated, when it is detected that the output of the first output unit 15 is off, the control unit 100F starts time measurement by the timer (not shown). For the predetermined time since it is detected that the output of the first output unit 15 is off, when it is detected that the output of the detection unit 103 becomes on, the control unit 100F executes the binding operation.

Example of Reinforcing Bar Binding Machine of Seventh Embodiment

Figure 27:
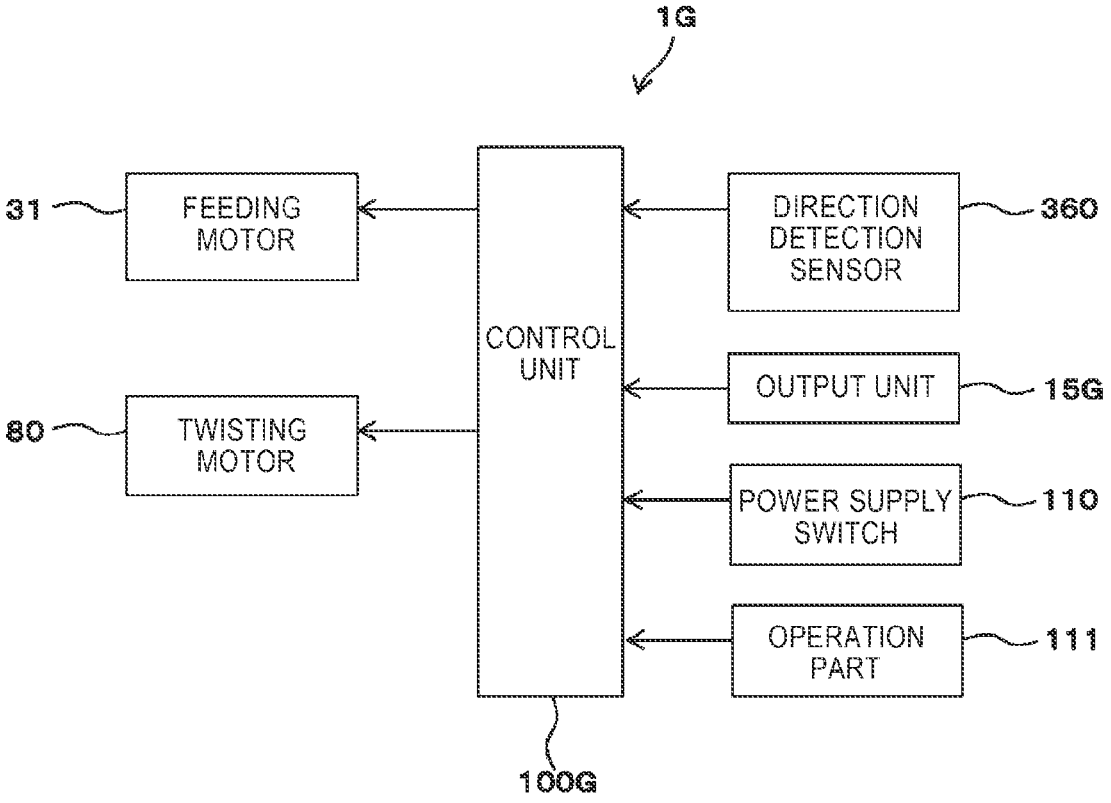
FIG. 27 is a functional block diagram of a reinforcing bar binding machine of a seventh embodiment.
Figure 28A:
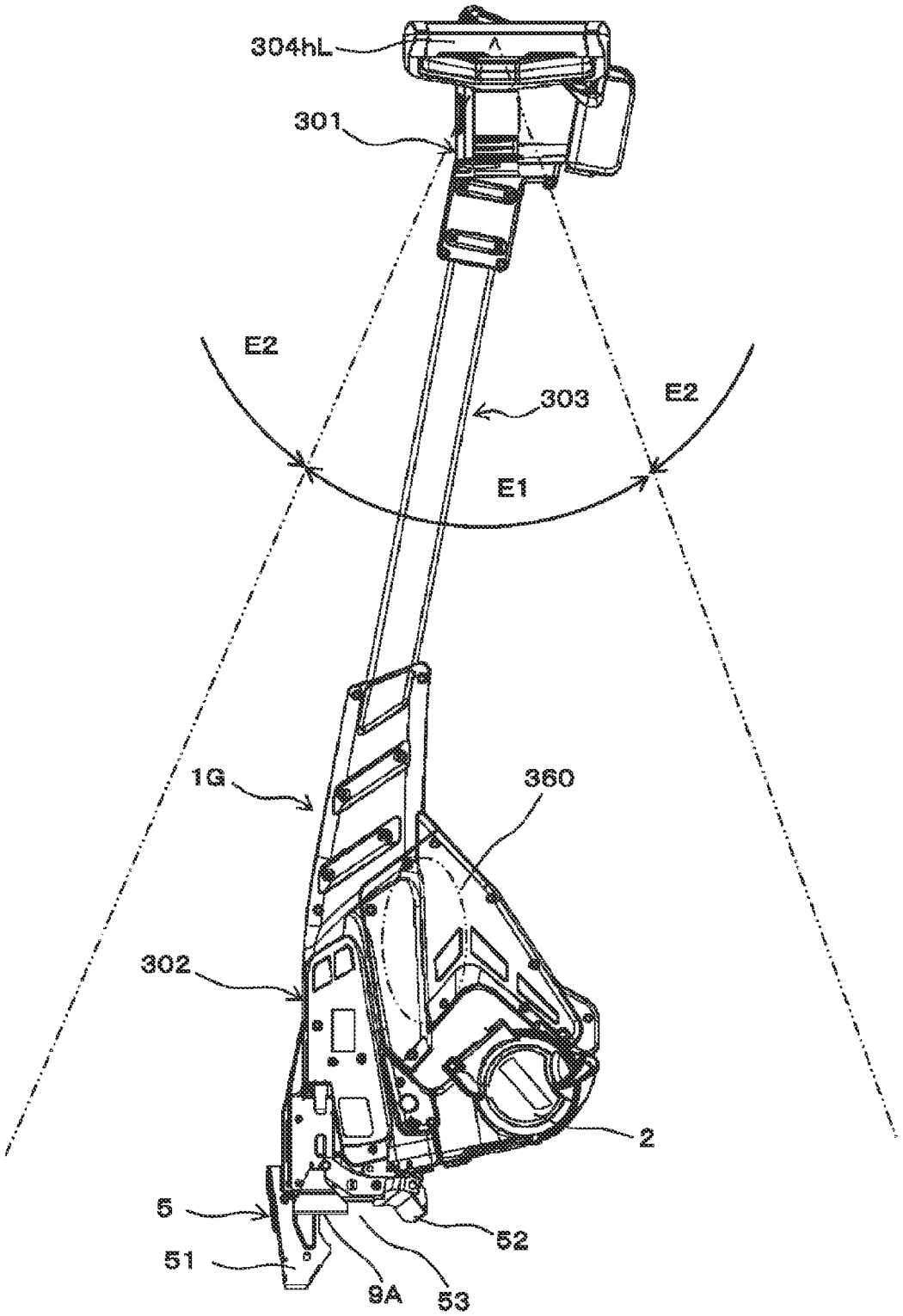
FIG. 28A is a side view depicting an example of an overall configuration of the reinforcing bar binding machine of the seventh embodiment.
Figure 28B:
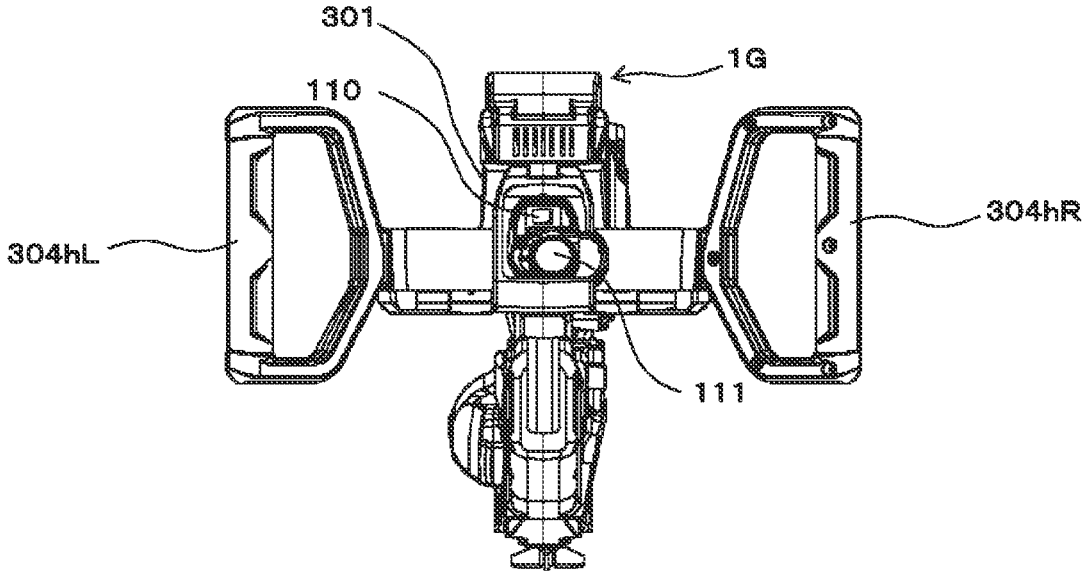
FIG. 28B is a rear view depicting the example of the overall configuration of the reinforcing bar binding machine of the seventh embodiment.

FIG. 27 is a functional block diagram of a reinforcing bar binding machine of a seventh embodiment, FIG. 28A is a side view depicting an example of an overall configuration of the reinforcing bar binding machine of the seventh embodiment, and FIG. 28B is a rear view depicting the example of the overall configuration of the reinforcing bar binding machine of the seventh embodiment. A reinforcing bar binding machine 1G of the seventh embodiment includes a first body part 301 configured to be held by a hand, a second body part 302 having a mechanism for binding reinforcing bars S with a wire W, and an elongated connecting part 303 configured to connect the first body part 301 and the second body part 302. The first body part 301 has a pair of handle parts 304*h*L and 304*h*R that can be gripped by an operator. The first body part 301 also has a power supply switch 110 with which operations of cutting off and turning on a power supply of the reinforcing bar binding machine 1G are performed, and an operation unit 111 having a dial capable of adjusting a binding force.

The reinforcing bar binding machine 1G includes an output unit 15G configured to detect that the second guide 52 is moved to the second position or the contact member 9A is moved to the actuation position and to output a signal, and a direction detection sensor 350 configured to detect a direction of the guide part 5 with respect to the direction of gravity, which is a direction of the reinforcing bar binding machine 1G, and to output a signal. In the reinforcing bar binding machine 1G, the outputs of the output unit 15G and the direction detection sensor 350 are detected by a control unit 100G. In the reinforcing bar binding machine 1G, an operation part is not provided to the handle part 304*h*.

The control unit 100G is configured to control the feeding motor 31 configured to drive the feeding gears 30 and the twisting motor 80 configured to drive the twisting unit 7 and the like, in response to the outputs of the output unit 15G and the direction detection sensor 350, thereby executing a series of operations of binding the reinforcing bars S with the wire W.

In the present example, in a state where the contact member 9A is moved to the standby position, the output of the output unit 15G is set to an off state. In addition, in a state where the contact member 9A is moved to the actuation position, the output of the output unit 15G is set to an on state.

Further, in a state where a direction of the reinforcing bar binding machine 1G is within a predetermined binding allowable range E1 in which the guide part 5 faces downward, the output of the direction detection sensor 350 is set to an on state, and in a state where the direction of the reinforcing bar binding machine 1G is within a range E2 outside the predetermined binding allowed range, the output of the direction detection sensor 350 is set to an off state.

Figure 29A:
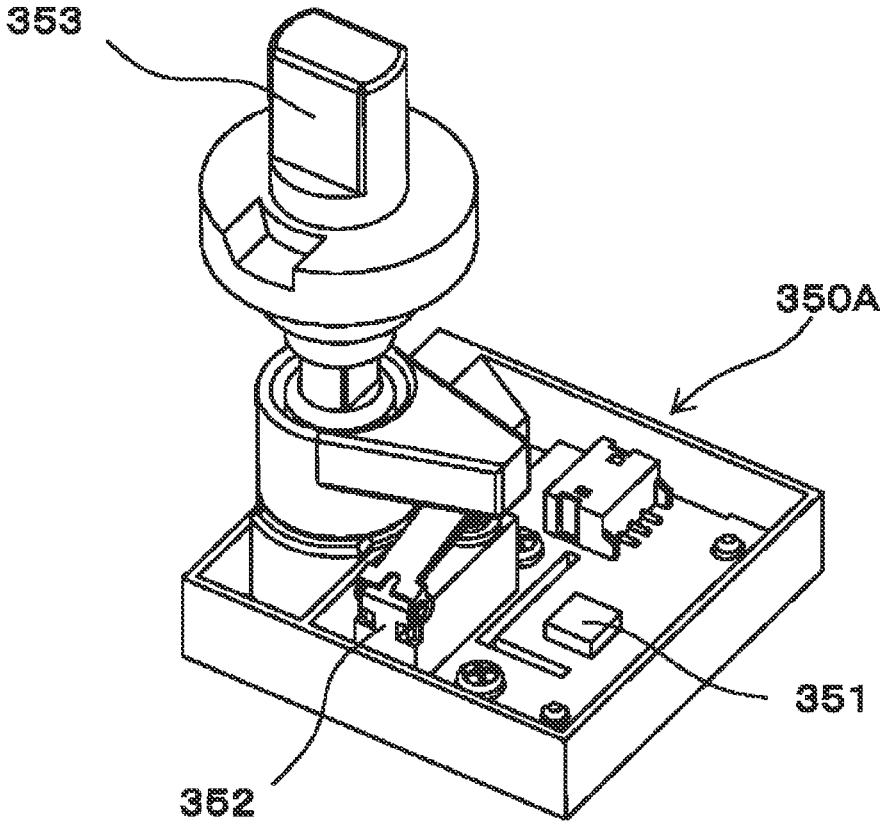
FIG. 29A is a perspective view depicting a direction detection sensor of the first embodiment.

FIG. 29A is a perspective view depicting a direction detection sensor of the first embodiment. A direction detection sensor 350A of the first embodiment is an example of the direction detection unit, and includes an acceleration sensor 351, a switch 252 configured to switch whether or not detection by the acceleration sensor 351, and an operation part 353 configured to switch on and off states of the switch 352.

The direction detection sensor 350A is provided to the second body part 302. In the present example, the direction detection sensor 350A is provided to an electric component unit 360 shown in FIG. 28A. In the electric component unit 360, a substrate on which the control unit 100G, a circuit configured to drive the feeding motor 31 and the twisting motor 80, components and the like are mounted is accommodated.

The acceleration sensor 351 is configured to detect a direction of the reinforcing bar binding machine 1G by detecting acceleration in at least one axis direction. The on and off states of the switch 352 are switched by the operation part 353, so that it is switched whether to validate or invalidate detection by the acceleration sensor 351.

Figure 29B:
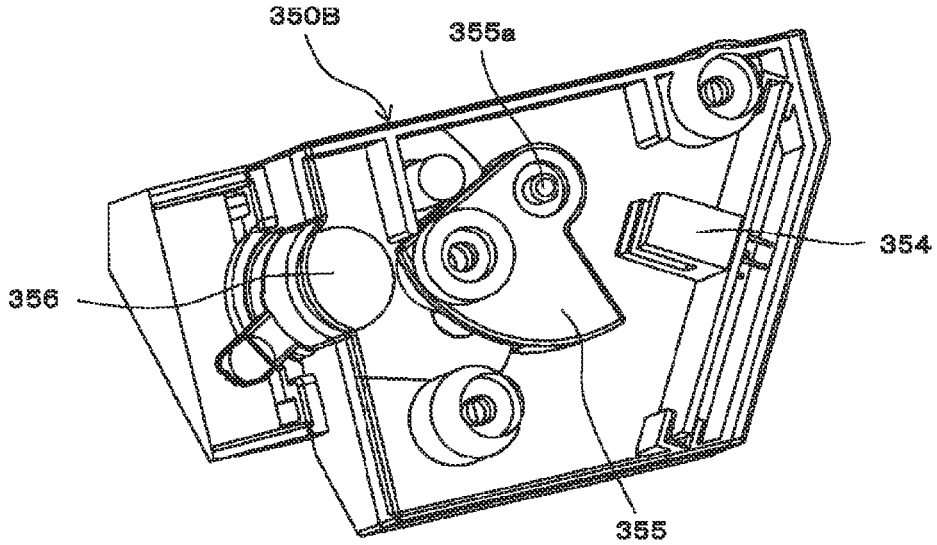
FIG. 29B is a perspective view depicting a direction detection sensor of the second embodiment.

FIG. 29B is a perspective view depicting a direction detection sensor of a second embodiment. A direction detection sensor 350B of the second embodiment is an example of the direction detection unit constituting a gravity sensor, and includes a photo sensor 354, a pendulum 355 that is detected by the photo sensor 354, and an operation part 356 configured to switch whether or not actuation of the pendulum 355.

The direction detection sensor 350B is provided to the second body part 302. In the present example, the direction detection sensor 350B is provided to the electric component unit 360 shown in FIG. 28A.

The pendulum 355 is configured to rotate about a shaft 355*a* as a support point, according to a direction of the reinforcing bar binding machine 1G, and it is switched whether to perform detection by the photo sensor 354, so that the direction of the reinforcing bar binding machine 1G is detected. It is switched whether to actuate the pendulum 355 by the operation unit 356, so that it is switched whether to validate or invalidate the detection by the photo sensor 354.

Figure 30A:
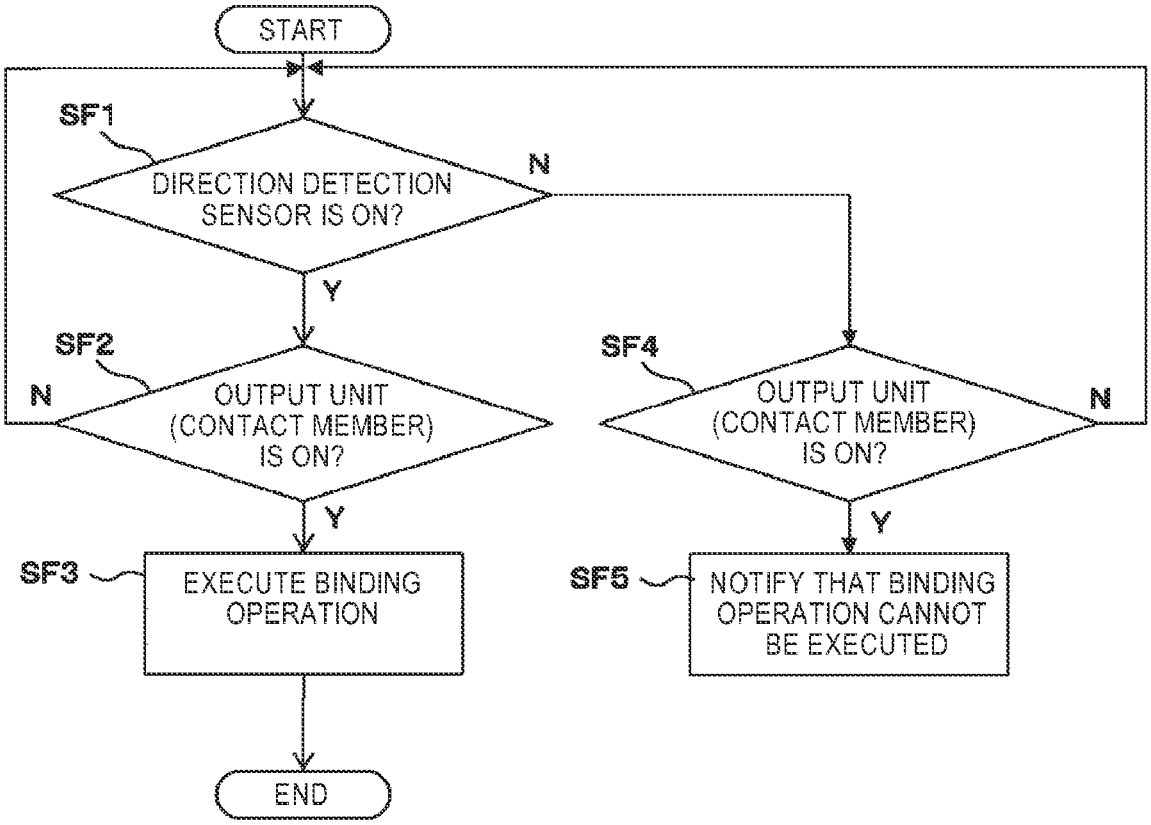
FIG. 30A is a flowchart depicting an example of operations of the reinforcing bar binding machine of the seventh embodiment.

FIG. 30A is a flowchart depicting an example of operations of the reinforcing bar binding machine of the seventh embodiment. Subsequently, an example of the operations of binding the reinforcing bars S with the wire W by the reinforcing bar binding machine 1G is described. In order to bind the reinforcing bars S at the feet of the operator, the reinforcing bar binding machine 1G is used with the guide part 5 facing downward in a state where the operator stands. The operator grips the handle parts 304*h* of the reinforcing bar binding machine 1G with both hands, aligns a position of the guide part 5 with an intersection point of the two reinforcing bars S, and inserts the reinforcing bars S into the insertion/pulling-out opening 53.

During the operation of inserting the reinforcing bars S into the insertion/pulling-out opening 53 between the first guide 51 and the second guide 52, the reinforcing bar binding machine 1G is moved in the first direction denoted with the arrow A1. Due to the relative movement of the reinforcing bar binding machine 1G and the reinforcing bars S, the contact part 9A is pushed by a force along the first direction and is thus moved to the actuation position.

When the contact member 9A is moved to the actuation position, the output of the output unit 15G is changed from an off state to an on state. Also, when the contact member 9A is moved to the actuation position, the second guide 52 is moved to the second position.

In step SF1 of FIG. 30A, the control unit 100G detects whether the direction of the reinforcing bar binding machine 1G is within a predetermined binding allowable range E1 and the direction detection sensor 350 is in an on state.

In a state where the direction detection sensor 350 becomes on and the direction of the reinforcing bar binding machine 1G is within the predetermined binding allowable range E1, when it is detected in step SF2 of FIG. 30A that the output unit 15G becomes on as the contact member 9A is moved to the actuation position, the control unit 100G controls the feeding motor 31 and the twisting motor 80 to execute a series of operations of binding the reinforcing bars S with the wire W, in step SF3.

In a state where the direction detection sensor 350 is not in the on state, i.e., the direction detection sensor 350 is in an off state and the direction of the reinforcing bar binding machine 1G is within a range E2 outside the predetermined binding allowable range, when it is detected in step SF4 of FIG. 30A that the output unit 15G becomes on as the contact member 9A is moved to the actuation position, the control unit 100G notifies in step SF5 that the binding operation cannot be executed by lighting of a lamp (not shown), a sound and the like.

After notifying that the binding operation cannot be executed, when it is detected that the output unit 15G becomes off as the contact member 9A is moved to the standby position, and the power supply is cut off and turned on by the operation on the power supply switch 110, the control unit 100G returns to step SF1. Then, in the state where the direction detection sensor 350 becomes on and the direction of the reinforcing bar binding machine 1G is within the predetermined binding allowable range E1, when it is detected that the output unit 15G becomes on as the contact member 9A is moved to the actuation position, the binding operation is executed.

Alternatively, after notifying that the binding operation cannot be executed, when it is detected that the output unit 15G becomes off as the contact member 9A is moved to the standby position, the control unit 100G returns to step SF1. Then, in the state where the direction detection sensor 350 becomes on and the direction of the reinforcing bar binding machine 1G is within the predetermined binding allowable range E1, when it is detected that the output unit 15G becomes on as the contact member 9A is moved to the actuation position, the binding operation is executed.

Alternatively, the control unit 100G returns to step SF1 after notifying that the binding operation cannot be executed. Then, in the state where the direction detection sensor 350 becomes on and the direction of the reinforcing bar binding machine 1G is within the predetermined binding allowable range E1, when it is detected that the output unit 15G remains in the on state as the contact member 9A is moved to the actuation position, the binding operation is executed.

Figure 30B:
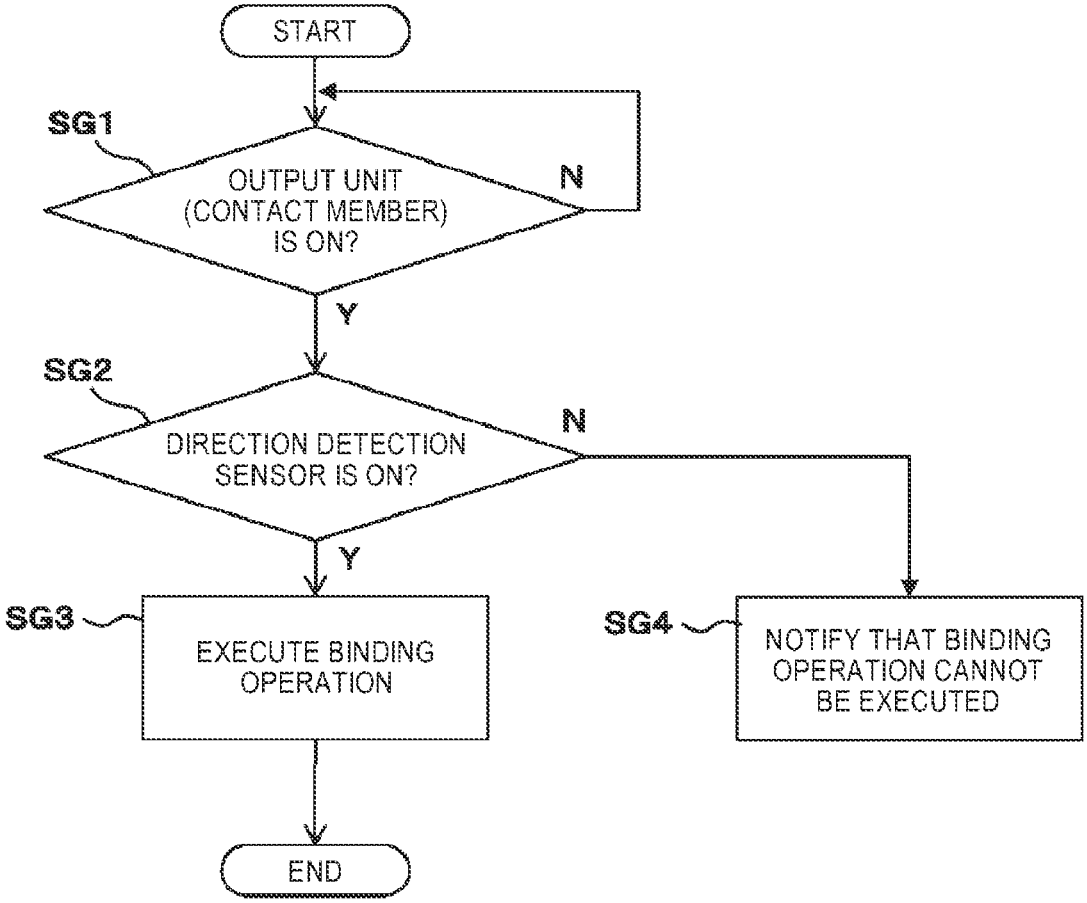
FIG. 30B is a flowchart depicting another example of operations of the reinforcing bar binding machine of the seventh embodiment.

FIG. 30B is a flowchart depicting another example of operations of the reinforcing bar binding machine of the seventh embodiment. In the below, another example of the operations of binding the reinforcing bars S with the wire W by the reinforcing bar binding machine 1G is described.

In a state where it is detected in step SG1 of FIG. 30B that the output unit 15G becomes on as the contact member 9A is moved to the actuation position, the control unit 100G detects in step SG2 of FIG. 30B whether the reinforcing bar binding machine 1A is within the predetermined binding allowable range E1 and the direction detection sensor 350 is on.

In a state where it is detected that the output unit 15G become on as the contact member 9A is moved to the actuation position, when it is detected that the direction detection sensor 350 becomes on because the direction of the reinforcing bar binding machine 1G is within the predetermined binding allowable range E1, the control unit 100G controls the feeding motor 31 and the twisting motor 80 to execute a series of operations of binding the reinforcing bars S with the wire W, in step SG3.

In a state where it is detected that the output unit 15G becomes on as the contact member 9A is moved to the actuation position, when it is detected that the direction detection sensor 350 is not in an on state, i.e., the direction of the reinforcing bar binding machine 1G is within the range E2 outside the predetermined binding allowable range and the direction detection sensor 350 is in an off state, the control unit 100G notifies in step SG4 that the binding operation cannot be executed by lighting of a lamp (not shown), a sound and the like.

After notifying that the binding operation cannot be executed, when it is detected that the output unit 15G become off as the contact member 9A is moved to the standby position and the power supply is cut off and turned on by the operation on the power supply switch 110, the control unit 100G returns to step SG1. Then, when it is detected that the output unit 15G becomes on as the contact member 9A is moved to the actuation position, the direction of the reinforcing bar binding machine 1G is within the predetermined binding allowable range E1 and the direction detection sensor 350 is in the on state, the binding operation is executed.

Alternatively, after notifying that the binding operation cannot be executed, when it is detected that the output unit 15G become off as the contact member 9A is moved to the standby position, the control unit 100G returns to step SG1. Then, when it is detected that the output unit 15G becomes on as the contact member 9A is moved to the actuation position, the direction of the reinforcing bar binding machine 1G is within the predetermined binding allowable range E1 and the direction detection sensor 350 is in the on state, the binding operation is executed.

Alternatively, after notifying that the binding operation cannot be executed, the control unit 100G returns to step SG1. Then, when it is detected that the output unit 15G becomes on as the contact member 9A is moved to the actuation position, the direction of the reinforcing bar binding machine 1G is within the predetermined binding allowable range E1 and the direction detection sensor 350 is in the on state, the binding operation is executed.

Note that, in the state where it is detected that the direction of the reinforcing bar binding machine 1G is within the range E2 outside the predetermined binding allowable range and the direction detection sensor 350 is in an off state, when it is detected that the output unit 15G becomes on as the contact member 9A is moved to the actuation position, the diverse settings of the reinforcing bar binding machine 1G may be performed. Further, in a state where the detection of the direction detection sensor 350 (350A, 350B) is invalidated, the control unit 100G may not execute the binding operation, and may enable the settings of the reinforcing bar binding machine 1G by the operation of the contact member 9A. In addition, in a state where the detection of the direction detection sensor 350 (350A, 350B) is validated, when a direction cannot be detected from the output of the direction detection sensor 350 (350A, 350B), the control unit 100G may determine that a failure occurs in the direction detection sensor 350 (350A, 350B) and issue a notification.

The binding allowable range may also be switched. For example, the reinforcing bar binding machine 1G is provided with the operation unit 111 such as a dial capable of adjusting a binding force, so that the binding allowable range may be switched using the operation unit 111. The binding allowable range may also be switched by the setting by the operation of the contact member 9A, the power supply on and off by the operation on the power supply switch 110, and the like. The binding allowable range may also be switched by combinations of an operation on the operation unit 111, the operation of the contact member 9A, the power supply on and off by the operation on the power supply switch 110, and the like.

In the reinforcing bar binding machine 1G of the seventh embodiment, the handle part 304*h* is not provided with the operation part, and it is switched whether to execute the binding operation, according to the direction of the reinforcing bar binding machine 1G, in addition to the movement of the contact member 9A to the actuation position or the movement of the second guide 52 to the second position. Thereby, an operation is simplified and occurrence of an erroneous operation can be suppressed.

Note that, the acceleration sensor is used as the direction detection sensor 350, so that a shock applied to the reinforcing bar binding machine 1G can be detected. Therefore, when it is detected that a predetermined shock is applied to the reinforcing bar binding machine 1G, the control unit 100G may determine that the reinforcing bars S are contacted, and execute the binding operation. In this case, it is not necessary to provide the detection unit configured to detect that the contact member 9A is moved to the actuation position and the second guide 52 is moved to the second position.

The subject application is based on Japanese Patent Application Nos. 2018-168249 filed on Sep. 7, 2018 and 2019-156058 filed on Aug. 28, 2019, the contents of which are incorporated herein by reference.

REFERENCE SIGNS LIST

1A, 1B, 1C, 1D, 1E, 1F, 1G . . . reinforcing bar binding machine, 11 . . . cover part, 12A, 14A . . . second output unit, 120 . . . movable element, 15, 15R, 15L . . . first output unit, 15G . . . output unit, 16 . . . third output unit, 2 . . . accommodation part, 20 . . . wire reel, 3 . . . feeding unit, 30 . . . feeding gear, 31 . . . feeding motor, 4 . . . regulation part, 42 . . . regulation member, 43 . . . regulation member, 44 . . . transmission mechanism, 5 . . . guide part, 51 . . . first guide, 51*g* . . . guide surface, 51*h* . . . groove portion, 51*c* . . . end portion, 52 . . . second guide, 52*a* . . . side guide, 52*b* . . . shaft, 52*c* . . . end portion, 53 . . . insertion/pulling-out opening, 54 . . . urging member, 59 . . . induction part, 6 . . . cutting unit, 60 . . . fixed blade part, 60*a* . . . opening, 61 . . . movable blade part, 62 . . . transmission mechanism, 7 . . . twisting unit, 70 . . . engaging part, 71 . . . actuation part, 8 . . . drive unit, 80 . . . twisting motor, 81 . . . decelerator, 82 . . . rotary shaft, 83 . . . movable member, 9A, 9B . . . contact member, 90A, 90B . . . shaft, 91A, 91B . . . contact part, 92A . . . connecting part, 93A . . . displacing part, 100A, 100B, 100C, 100D, 100E, 100G . . . control unit, 101T . . . timer, 103 . . . detection unit, 110 . . . power supply switch, 111 . . . operation part, 301 . . . first body part, 302 . . . second body part, 303 . . . connecting part, 304*h* . . . handle part, 304L, 304R . . . grip part, 304*t*, 304*t*R, 304*t*L . . . operation part, 305 . . . joining part, 305*h* . . . grip part, 305*t*1 . . . sub-operation part (first sub-operation part), 305*t*2 . . . sub-operation part (second sub-operation part), 320*h* . . . handle part, 350 (350A, 350B) . . . direction detection sensor (direction detection unit), W . . . wire

The invention claimed is:

1. A binding machine comprising:

a first body part having an operation part configured to be operated by an operator;

a second body part having a feeding unit configured to feed a wire, a guide part configured to guide the wire fed by the feeding unit to surround a binding object, and a twisting unit configured to twist the wire guided by the guide part, thereby binding the binding object;

an elongated connecting part configured to connect the first body part and the second body part;

a first output unit configured to detect an operation on the operation part and to output a first signal;

a second output unit including a sensor configured to detect that the binding object is inserted in a feeding path of the wire guided by the guide part and to output a second signal; and a control unit configured to control the feeding unit and the twisting unit to execute a binding operation in response to detection of the first signal output from the first output unit and the second signal output from the second output unit, wherein the control unit is configured to execute the binding operation even though the output of the first signal becomes off by the operation of the operation part being released in response to detection of the second signal after detection of the first signal generated by operating the operation part until a predetermined time elapses.

2. The binding machine according to claim 1, further comprising a contact part to which the binding object is contacted, wherein in response to the binding object contacting the contact part, the second output unit is configured to output the second signal.

3. The binding machine according to claim 1, further comprising:

a first sub-operation part provided to the connecting part and configured to be operated by the operator, and a third output unit configured to detect an operation on the first sub-operation part and to output a third signal, wherein the control unit is configured to execute the binding operation in response to detection of the third signal output from the third output unit and the second signal output from the second output unit.

4. The binding machine according to claim 1, further comprising:

a second sub-operation part provided to the second body part and configured to be operated by the operator, and a third output unit configured to detect an operation on the second sub-operation part and to output a third signal, wherein the control unit is configured to execute the binding operation in response to detection of the third signal output from the third output unit and the second signal output from the second output unit.

5. The binding machine according to claim 1, wherein when the output of the first signal becomes off by the operation of the operation part being released, the control unit is configured to regard the output of the first signal as being on until the predetermined time elapses.

6. A binding machine comprising:

a first body part having an operation part configured to be operated by an operator;

a second body part having a feeding unit configured to feed a wire, a guide part configured to guide the wire fed by the feeding unit to surround a binding object, and a twisting unit configured to twist the wire guided by the guide part, thereby binding the binding object;

an elongated connecting part configured to connect the first body part and the second body part;

a first output unit configured to detect an operation on the operation part and to output a first signal;

a second output unit including a sensor configured to detect that the binding object is inserted in a feeding path of the wire guided by the guide part and to output a second signal; and a control unit configured to control the feeding unit and the twisting unit to execute a binding operation in response to detection of the first signal generated by operating the operation part and output from the first output unit and the second signal output from the second output unit, wherein the control unit is configured to execute the binding operation even though the output of the first signal becomes off by the operation of the operation part being released in response to detection of the second signal after a previous binding operation is executed until a predetermined time elapses.

7. A binding machine comprising:

a first body part having an operation part configured to be operated by an operator;

a second body part having a feeding unit configured to feed a wire, a guide part configured to guide the wire fed by the feeding unit to surround a binding object, and a twisting unit configured to twist the wire guided by the guide part, thereby binding the binding object;

an elongated connecting part configured to connect the first body part and the second body part;

a first output unit configured to detect an operation on the operation part and to output a first signal;

a second output unit including a sensor configured to detect that the binding object is inserted in a feeding path of the wire guided by the guide part and to output a second signal; and a control unit configured to control the feeding unit and the twisting unit to execute a binding operation in response to detection of the first signal generated by operating the operation part and output from the first output unit and the second signal output from the second output unit, wherein the control unit is configured to execute the binding operation in response to detection of the second signal until a predetermined time elapses without detection of the first signal by the operation of the operation part being released.

8. A binding machine comprising:

a first body part having a handle part that can be gripped by an operator;

a second body part having a feeding unit configured to feed a wire, a guide part configured to guide the wire fed by the feeding unit to surround a binding object, and a twisting unit configured to twist the wire guided by the guide part, thereby binding the binding object;

an elongated connecting part configured to connect the first body part and the second body part;

a direction detection sensor configured to detect a direction of the guide part with respect to a direction of gravity;

an output unit configured to output a signal indicating that the binding object is inserted in a feeding path of the wire guided by the guide part; and a control unit configured to control the feeding unit and the twisting unit to execute a binding operation in response to detection of the signal output from the output unit and in response to a determination that the direction of the guide part with respect to the direction of gravity detected by the direction detection sensor is within a binding allowable range.

9. The binding machine according to claim 8, wherein the direction detection sensor is provided to the second body part.

10. The binding machine according to claim 8, wherein the direction detection sensor is an acceleration sensor or a gravity sensor.

11. The binding machine according to claim 8, wherein the binding allowable range in which the binding operation is configured to be executed is switched.

12. A binding machine comprising:

a first body part having a handle part configured to be gripped by an operator;

a second body part having a feeding unit configured to feed a wire, a guide part configured to guide the wire fed by the feeding unit to surround a binding object, and a twisting unit configured to twist the wire guided by the guide part, thereby binding the binding object;

an elongated connecting part configured to connect the first body part and the second body part;

an acceleration sensor configured to detect a shock; and a control unit configured to control the feeding unit and the twisting unit to execute a binding operation in response to detection of a shock by the acceleration sensor.

* * * * *